US012601232B1

(12) United States Patent
Ingram et al.

(10) Patent No.: US 12,601,232 B1
(45) **Date of Patent: *Apr. 14, 2026**

(54) EXTENDED REACH POWER TRACK TOOL USED ON COILED TUBING

(71) Applicant: Weatherford Technology Holdings, LLC, Houston, TX (US)

(72) Inventors: Gary D. Ingram, Houston, TX (US); Keith Adams, Katy, TX (US); Detlef Boss, The Woodlands, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/918,492

(22) Filed: Oct. 17, 2024

Related U.S. Application Data

(60) Provisional application No. 63/706,863, filed on Oct. 14, 2024.

(51) Int. Cl.
*E21B 23/00* (2006.01)

(52) U.S. Cl.
CPC ..... *E21B 23/001* (2020.05)

(58) Field of Classification Search
CPC ..... E21B 23/001
See application file for complete search history.

(56) References Cited

U.S. PATENT DOCUMENTS 4,085,808 A 4/1978 Kling
6,082,461 A 7/2000 Newman et al.
6,273,189 B1 8/2001 Gissler et al.
6,722,442 B2 4/2004 Simpson
6,868,906 B1 3/2005 Vail, III et al.
7,051,587 B2 5/2006 Simpson et al.
7,156,192 B2 1/2007 Guerrero et al.
7,172,026 B2 2/2007 Misselbrook
(Continued)

FOREIGN PATENT DOCUMENTS

CN 102808589 A 12/2012
CN 107605418 A 1/2018
(Continued)

OTHER PUBLICATIONS

Int'l Search Report and Written Opinion in PCT/US2023/086478 dated Mar. 27, 2024, 4-pgs.
(Continued)

*Primary Examiner* — James G Sayre
(74) *Attorney, Agent, or Firm* — Cabello Hall Zinda, PLLC

(57) ABSTRACT

A traction tool is operable with fluid flow from coiled tubing for use in a wellbore. The traction tool includes a mandrel, a driver, at least one piston, and a motor. The driver is rotatably disposed on the mandrel and can be movable between retracted and extended conditions when the at least one piston is actuated. The driver in the extended condition is configured to engage inside the wellbore. The piston is adjacent to the driver and is actuated by the fluid flow from the mandrel. The motor is also actuated by the fluid flow from the mandrel. The motor imparts rotation to the piston and the drive, which can be supported by bearings on the tool's mandrel. Tracks on the driver arranged at an angle
(Continued)

transverse to a longitudinal axis of the tool allow the rotating driver to spiral inside the wellbore and advance the traction tool.

20 Claims, 14 Drawing Sheets

(56) References Cited

U.S. PATENT DOCUMENTS

| | | | | |
|---|---|---|---|---|
| 7,610,970 | B2 | 11/2009 | Sihler et al. | |
| 7,770,667 | B2 | 8/2010 | Moore | |
| 7,836,950 | B2 | 11/2010 | Vail, III et al. | |
| 7,954,563 | B2 | 6/2011 | Mock et al. | |
| 8,245,796 | B2 | 8/2012 | Mock et al. | |
| 9,097,086 | B2 | 8/2015 | AlDossary | |
| 9,657,542 | B2 | 5/2017 | Al-Mulhem | |
| 9,719,315 | B2 | 8/2017 | Hughes et al. | |
| 9,874,061 | B2 | 1/2018 | Bedrossian | |
| 10,227,825 | B2 | 3/2019 | Randall | |
| 10,260,299 | B2 | 4/2019 | Randall | |
| 10,927,610 | B2 | 2/2021 | Saeed et al. | |
| 10,927,625 | B2 | 2/2021 | Fleckenstein et al. | |
| 12,258,826 | B2 * | 3/2025 | Adams | E21B 23/042 |
| 2002/0032126 | A1 | 3/2002 | Kusmer | |
| 2008/0066963 | A1 | 3/2008 | Sheiretov et al. | |
| 2012/0061075 | A1 | 3/2012 | Mock | |
| 2013/0199846 | A1 | 8/2013 | Krueger et al. | |
| 2019/0345785 | A1 * | 11/2019 | Fleckenstein | E21B 23/14 |
| 2019/0368290 | A1 | 12/2019 | Vick, Jr. et al. | |
| 2020/0332606 | A1 | 10/2020 | Santos et al. | |
| 2024/0328268 | A1 | 10/2024 | Adams et al. | |

FOREIGN PATENT DOCUMENTS

| | | | | |
|---|---|---|---|---|
| GB | 2362405 | A * | 11/2001 | E21B 23/10 |
| GB | 2533018 | A | 6/2016 | |
| WO | 2005090739 | A1 | 9/2005 | |
| WO | 2017029613 | A1 | 2/2017 | |

OTHER PUBLICATIONS

Welltec, "Datasheet Well Tractor(R) 212 Coiled Tubing," Datasheet, dated Nov. 12, 2020, 1-pg.

WWT International, "WWT 312 Milling Tractor(TM)," Brochure, copyright 2017, dated Mar. 2018, 1-pg.

WWT International, "WWT 312 Milling Tractor(TM)," PowerPoint Presentation, undated, 21-pgs.

WWT International, "WWT Coiled Tubing Tractor(TM)," Brochure, undated, 2-pgs.

Int'l Search Report and Written Opinion in PCT App. PCT/US2025/046387, dated Nov. 26, 2025, 11 pgs.

* cited by examiner

SECTION I-I

SECTION II-II

SECTION II-II
DRIVE HOUSING ROTATED

EXTENDED REACH POWER TRACK TOOL USED ON COILED TUBING

CROSS-REFERENCE TO RELATED APPLICATIONS

This application claims the benefit of U.S. Provisional Appl. 63/706,863 filed Oct. 14, 2024, which is incorporated herein by reference in its entirety. This application is also with U.S. Non-provisional application Ser. No. 18/126,712 filed Mar. 27, 2023, published as U.S. Patent Pub. No. 2024/0328268, which is incorporated herein by reference in its entirety.

BACKGROUND OF THE DISCLOSURE

A bottom hole assembly can be deployed downhole on coiled tubing to conduct intervention-based operations in a wellbore. Many wellbores have extended horizontal sections, which present a number of challenges for the bottom hole assembly to reach total depth.

Use of a friction reduction tool is the most common technique to extend the reach of coil tubing in an extended horizonal section of a wellbore. The friction reduction tool is run on the coil tubing above a downhole motor. Fluid is pumped through the friction reduction tool, and a rotor of the friction reduction tool rotates a valve at high speed. As the valve opens and closes, a fluid hammering effect is produced on the coil tubing. The resulting movement from the hammering effect reduces the friction of the coil tubing in the wellbore and facilitates running-in of the coil tubing further into the wellbore. As a downside, the friction reduction tool produces a significant amount of vibration, which can cause early fatigue failures on the coiled tubing and the bottom hole assembly equipment.

In unconventional markets, for example, operators are steadily increasing the lengths of the horizontal sections in the wellbore. The extent of a horizontal section that an operator is able to drill can be limited because fracture plugs used in the extended horizontal section need to be milled out after a fracture operation is completed. This limitation is forcing the industry to develop even more aggressive friction reduction tools, which increases early fatigue in both the coil tubing and the tools of the bottom hole assembly. In some cases, the coil tubing string may fail at just a fraction of its useful life.

Coil tubing tractors have also been used to extend the reach in an extended horizontal section of a wellbore. These coil tubing tractors are very similar in nature to the ones used for wireline but are driven by fluid via the coil tubing.

As an example, FIG. 1 illustrates operation of a typical gripping tractor 50 according to the prior art for coiled tubing. The tractor 50 includes a downhole toe gripper 52 and an uphole heel gripper 54 connected by a mandrel 58 of a hydraulic ram 56. The tractor 50 is deployed on coil tubing string 20 into a wellbore 10. When further run-in cannot be achieved (Stage 1), the heel gripper 54 is activated to grip the wellbore 10 using grips 55 (Stage 2). The hydraulic ram 56 is activated to extend the deactivated toe gripper 52 further in the wellbore 10 (Stage 3). This also draws the coil tubing string 20 forward. Then, the heel gripper 54 is deactivated, and the toe gripper 52 is activated to grip the wellbore 10 using grips 53 (Stage 4). Finally, the hydraulic ram 56 is reset to bring the heel gripper 54 forward (Stage 5) so the tractor 50 can be ready to cycle again.

Many bottom hole assemblies use a milling tool to perform downhole operations. Conventional coiled tubing tractors are difficult to control to allow for motor operations during milling because the tractor is either on or off. Moreover, the conventional coiled tubing tractors can be complex and expensive, which has limited their acceptance in the market.

What is needed is an improved assembly used with coiled tubing to carry out intervention-based operations in an extended horizontal section of a wellbore that can provide sufficient weight on bit and can ultimately reach total depth for the extended reach operation. The subject matter of the present disclosure is directed to overcoming, or at least reducing the effects of, one or more of the problems set forth above.

SUMMARY OF THE DISCLOSURE

According to the present disclosure, a traction tool is operable with fluid flow from coiled tubing for use in a wellbore. The traction tool comprises a motor, a driver piston, a driver, and an anchor. The motor has a stator and a drive shaft, with the drive shaft rotatably disposed within the stator. The drive shaft extends along a longitudinal axis and contains a bore for the passage of fluid flow. The motor is configured to impart rotation to the drive shaft about the longitudinal axis in response to hydraulic pressure of the fluid flow in a space between the stator and the drive shaft.

The driver piston is positioned on the drive shaft adjacent to the motor and rotates with the drive shaft. The driver piston is capable of longitudinal movement in response to hydraulic pressure communicated from the motor. The driver, which is disposed adjacent to the driver piston, also rotates with the drive shaft. The driver moves in response to the movement of the driver piston and can shift between a retracted and an extended position relative to the longitudinal axis. When extended, the driver engages the wellbore, with part of the driver positioned at an angle transverse to the longitudinal axis.

The anchor is connected to the drive shaft via a rotatable connection and is situated adjacent to the driver. The anchor has one or more anchor elements, an anchor piston, and an anchor piston chamber. The anchor piston moves toward the anchor elements in response to hydraulic pressure from the shaft bore of the drive shaft to the anchor piston chamber. This movement causes the anchor elements to extend and engage with the wellbore.

In one arrangement for the driver, the driver can include a plurality of carriers disposed around the longitudinal axis, with each carrier hingedly connected to opposing linkage arms. These linkage arms can be hingedly connected between sections of the traction tool disposed on the drive shaft. The portion of the driver positioned at an angle transverse to the longitudinal axis can include wheels rotatably mounted on the carriers. The linkage arms can be designed to extend and retract the carriers in response to the movement of the driver piston in the longitudinal direction.

In another arrangement for the driver, the driver can include a plurality of segments disposed around the longitudinal axis, with each segment engaged between opposing ramps of the traction tool disposed on the drive shaft. The portion of the driver positioned at an angle transverse to the longitudinal axis can comprise either one or more teeth or tracks disposed on the segments, or one or more wheels rotatably mounted on the segments. The driver piston can be configured to move one of the ramps longitudinally toward the other ramp, with the ramps designed to extend and retract the segments in response to this movement.

In the traction tool, the driver can move in response to a first level of hydraulic pressure that overcomes the driver's initial bias. The anchor piston can move in response to a second, higher level of hydraulic pressure that overcomes the anchor's initial bias.

In one configuration of this traction tool, the traction tool can include a ram positioned adjacent to the anchor. The ram can comprise a ram arm and a ram piston chamber, with the ram arm extendable along the longitudinal axis in response to hydraulic pressure in the ram piston chamber. The driver can move in response to a first level of hydraulic pressure overcoming the driver's bias, while the anchor piston can move in response to a second, higher level of hydraulic pressure overcoming the anchor's bias. Additionally, the ram arm can extend in response to a third level of hydraulic pressure in the ram piston chamber, which overcomes the ram's bias. This third pressure level can be higher than the first.

In one drive arrangement, the traction tool can include a driver piston that comprises a piston chamber disposed in fluid communication with the bore of the drive shaft. The driver piston can move longitudinally in response to hydraulic pressure in the piston chamber, causing the driver to move laterally between the retracted and extended conditions relative to the longitudinal axis. For this drive arrangement, a pressure relief valve can be disposed in fluid communication between the piston chamber and a relief chamber of the driver piston. The pressure relief valve can communicate hydraulic pressure from the piston chamber to the relief chamber when a predetermined pressure level is reached. An outlet port in the driver piston may be provided to communicate the relief chamber with the exterior of the traction tool.

In another drive arrangement, the traction tool can include a driver piston having a piston chamber in fluid communication with the space between the drive shaft and the stator. The driver piston can move longitudinally in response to hydraulic pressure communicated to the piston chamber, which causes the driver to move laterally between the retracted and extended positions relative to the longitudinal axis. For this drive arrangement, a control valve can be disposed in fluid communication between the motor's space and the piston chamber of the driver piston. The control valve can regulate the communication of hydraulic pressure from the motor space to the piston chamber.

In arrangements of the motor, restriction can be disposed in the shaft bore of the drive shaft. The restriction can create a pressure differential upstream of the restriction in the shaft bore. For the motor, fluid chambers can be defined by the space between the stator and the drive shaft. These fluid chambers can be selectively placed in fluid communication with both an inlet and an outlet for fluid flow. The stator can include a stator housing that defines an inner passage with lobes where the drive shaft is disposed. The drive shaft can have vanes that are biased to engage the inner passage. An intake plate having intake orifices can define the inlet for the fluid chambers, while an exhaust plate having exhaust orifices can define the outlet for the fluid chambers. Neither the intake plate nor exhaust plate rotate with the drive shaft but are fixed to stator housing.

The traction tool, as described, can include a first spline connection that couples a first drive housing to the drive shaft and a second spline connection that couples the first drive housing to a second drive housing.

In one anchor arrangement, the anchor can include a mandrel with a mandrel bore in fluid communication with the shaft bore of the drive shaft. The anchor can use a rotatable connection that includes a bearing disposed between the drive shaft and the mandrel. Anchor elements of the anchor can include slips. The anchor can include a holder movably disposed on the mandrel, with the slips hingedly connected to the holder. First and second cones can be disposed on the mandrel adjacent to each end of the slips. The anchor piston, which is in fluid communication with a port in the mandrel, can move longitudinally from a first to a second position in response to hydraulic pressure. The first cone can move toward the second cone, and the ends of the slips can be engaged between the first and second cones, moving from a retracted condition to an extended condition. A return spring can bias the anchor piston toward the first position.

For the cones of the anchor arrangement, the first cone can include a first ramp fixedly connected to the anchor piston, a second ramp slidably connected to the first ramp, and an extension hingedly connected to the second ramp. The first ramp can move with the anchor piston, while the extension can rotate outward in response to engagement with the first ramp. The second ramp can move against the slip's end in response to the first ramp's movement. A return spring can bias the second ramp away from the first ramp, and a leaf spring can bias the extension toward the mandrel.

For this anchor arrangement, the traction tool can include a ram with at least one ram arm movably disposed on the mandrel. The ram arm can define a ram piston chamber that is in fluid communication with the mandrel bore via a port. The ram arm can extend along the longitudinal axis of the mandrel in response to hydraulic pressure in the ram piston chamber.

According to the present disclosure, a traction tool, operable with fluid flow from coiled tubing for use in a wellbore, includes a motor, a driver piston, a driver, and a milling tool. The motor has a stator and a drive shaft. The drive shaft is rotatably disposed in the stator, extending along a longitudinal axis and containing a bore for fluid passage. The motor imparts rotation to the drive shaft along the longitudinal axis in response to hydraulic pressure of the fluid flow in a space between the stator and drive shaft. The driver piston is disposed on the drive shaft adjacent to the motor, rotating with the shaft, and movable longitudinally in response to hydraulic pressure from the motor. The driver, which is disposed adjacent to the driver piston, rotates with the drive shaft and moves in response to the piston. The driver shifts between retracted and extended positions along the longitudinal axis, engaging the wellbore when extended. Finally, the milling tool is disposed adjacent to the driver.

According to the present disclosure, a traction tool, operable with fluid flow from coiled tubing for use in a wellbore, includes a motor, a driver piston, a driver, and a ram. The motor has a stator and a drive shaft. The drive shaft is rotatably disposed in the stator, extending along a longitudinal axis with a bore for fluid passage. The motor imparts rotation to the drive shaft in response to hydraulic pressure of the fluid flow in a space between the stator and drive shaft. The driver piston, which is disposed on the drive shaft adjacent to the motor, rotates with the shaft and moves longitudinally in response to hydraulic pressure. The driver, which is disposed adjacent to the driver piston, rotates with the drive shaft and moves between retracted and extended positions along the longitudinal axis, engaging the wellbore when extended. Finally, the ram, which is disposed adjacent to the driver and is connected by a rotatable connection to the drive shaft, includes a ram arm and a piston chamber. The ram arm extends along the longitudinal axis in response to hydraulic pressure in the piston chamber.

According to the present disclosure, a bottom hole assembly, operable with fluid flow from coiled tubing for use in a wellbore, includes an operational tool and at least one traction tool, as described above, connected between the coiled tubing and the operational tool.

According to the present disclosure, a method for use in a wellbore includes deploying a traction tool on coiled tubing in the wellbore, operating a motor on the traction tool using fluid flow from the coiled tubing, and transferring rotation from the motor to a rotating driver on the traction tool. The method involves selectively engaging transverse portions of the rotating driver against the wellbore by operating at least one piston using fluid flow, moving the rotating driver from a retracted to an extended condition, advancing the traction tool along the wellbore by riding the driver's transverse portions along the wellbore, and engaging an anchor on the traction tool in response to a second level of hydraulic pressure greater than the first level used for the rotating driver. The method can further include extending a ram on the traction tool along the longitudinal axis in response to a third level of hydraulic pressure greater than the second level.

The foregoing summary is not intended to summarize each potential embodiment or every aspect of the present disclosure.

BRIEF DESCRIPTION OF THE DRAWINGS

FIG. 1 illustrates operation of a typical gripping tractor according to the FIGS. 4A-4G illustrate portions of a traction tool of the present disclosure in cross-section.

DETAILED DESCRIPTION OF THE DISCLOSURE

A. System

Figure 1:
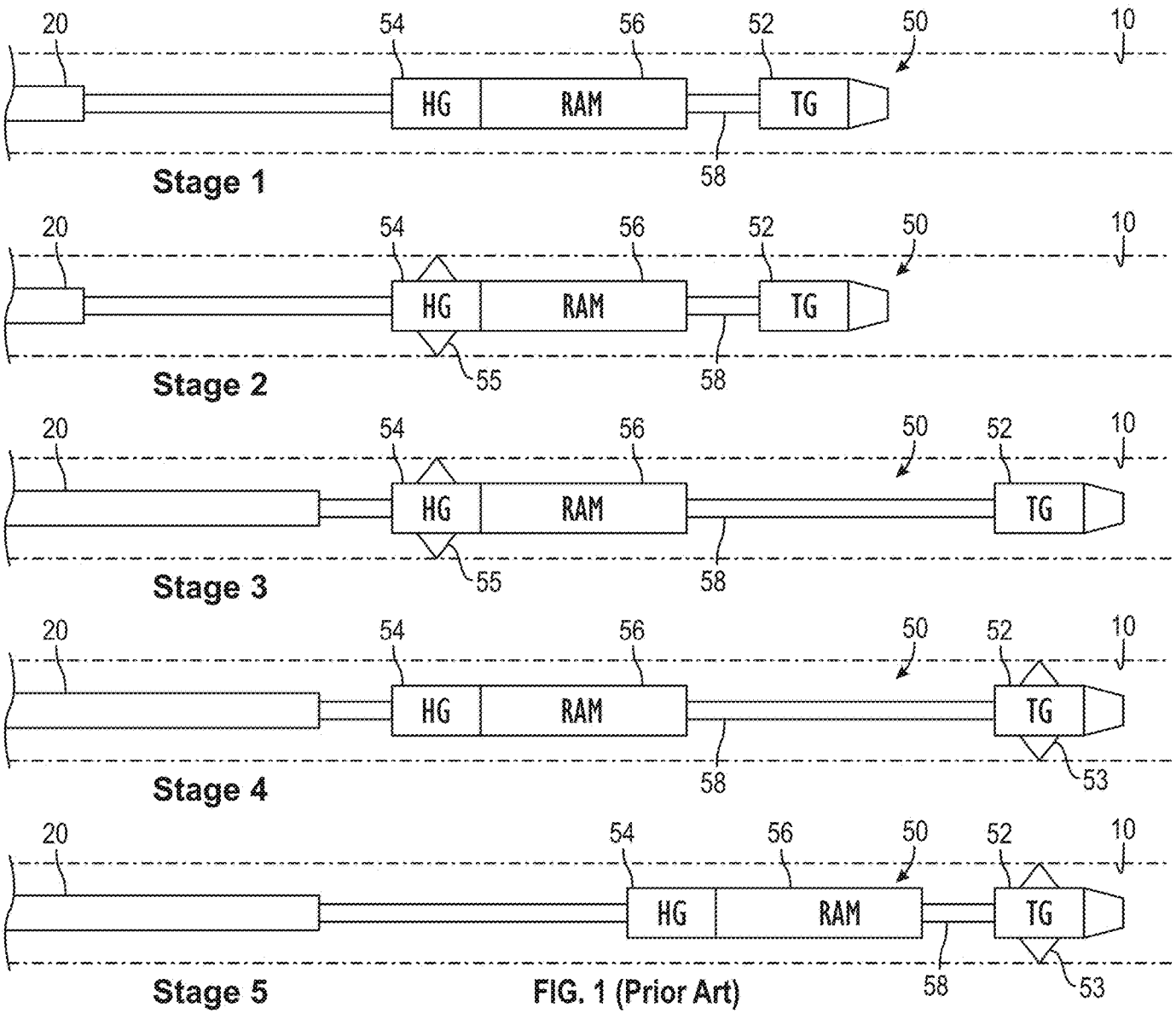
FIG. 1 (Prior Art)
FIG. 1 illustrates operation of a typical gripping tractor according to the Prior Art
Figure 2:
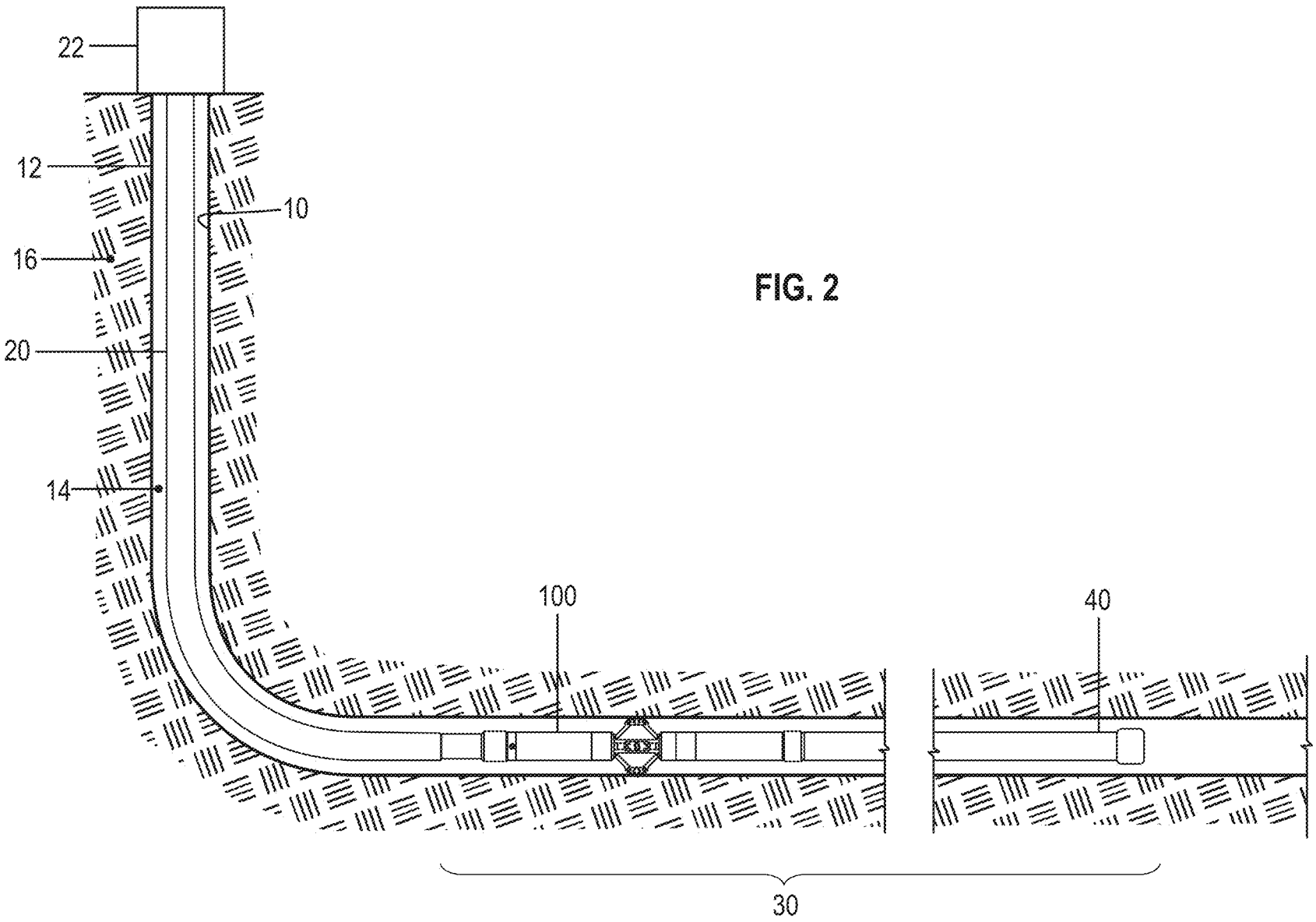
FIG. 2 illustrates a traction tool of the present disclosure being used to extend the reach of coil tubing in a wellbore.

FIG. 2 schematically illustrates an example implementation in which a power track or a traction tool 100 according to the present disclosure. A coiled tubing string 20 is used to deploy a bottom hole assembly 30 in a wellbore 10 in a formation 16. The coiled tubing string 20 can be deployed by an appropriate deployment system 22 known and used in the art. The wellbore 10 can be a cased wellbore having tubing or casing 12.

The bottom hole assembly 30 includes one or more traction tools 100 of the present disclosure and includes one or more downhole tools 40. The bottom hole assembly 30 is deployed downhole on the coiled tubing string 20 to carry out intervention-based operations in the extended horizontal section of the wellbore 10. For example, the downhole tool 40 can be a milling tool having a motor and a mill for use in milling operations downhole.

A traction tool 100 is used to extend the reach of the bottom hole assembly 30, especially in an extended horizontal section of the wellbore 10. One configuration of a suitable traction tool 100 for the purposed disclosed herein is disclosed in co-pending U.S. application Ser. No. 18/126,712 filed Mar. 27, 2023, published as US2024/0328268, which is incorporated herein by reference in its entirety.

Preferably, the traction tool 100 according to the present disclosure is able to automatically adjust its running outside diameter, allowing the traction tool 100 to move through any restrictions in the annular area 14 of the casing 12. Additionally, the traction tool 100 preferably minimizes vibrations produced so the life of the coiled tubing string 20 and the bottom hole assembly 30 can be extended. The traction tool 100 can adjust the generated forward force to enable a predefined weight on bit, which can improve milling times in horizontal wells.

As discussed herein, one or more of the traction tools 100 can be used on the bottom hole assembly 30 deployed on the coiled tubing string 20. The bottom hole assembly 30 can include one or more operational tools 40, such as a milling tool or the like. The one or more traction tools 100 can be used to extend the reach of the coiled tubing string 20 so the operational tool 40 can perform a desired operation. Advantageously, a bore of a mandrel inside the traction tool 100 allows for fluid flow to pass through the traction tool 100 to reach the operational tool 40.

B. Outline of Operation

FIGS. 3A-3D briefly outline operation of a traction tool 100 according to the present disclosure. The traction tool 100 includes a motor 140, a driver piston 120, a driver 110, an anchor 200, and a ram 240. The driver piston 120 acts against the driver 110 to extend and retract the driver 110. A valve 130 (e.g., a pressure relief valve) as discussed below can be used with the driver piston 120.

Figure 3A:
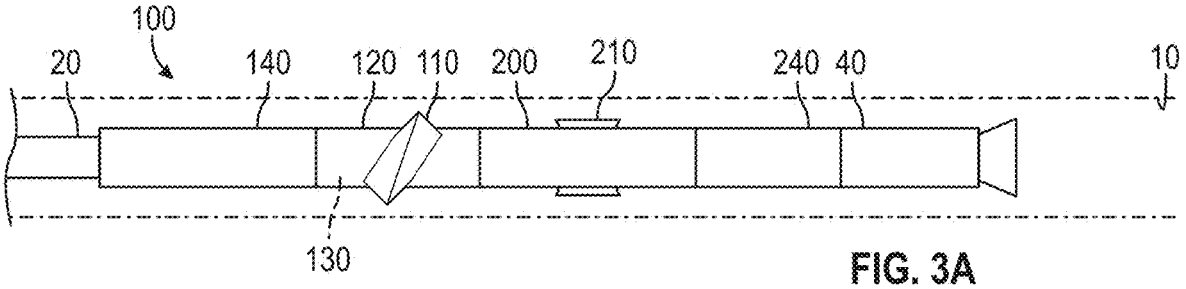
FIGS. 3A-3D illustrate an example operation of a traction tool of the present disclosure.

During run-in as shown in FIG. 3A, the fluid flow is low. The motor 140 rotates an internal rotor (not shown), which turns the driver piston 120 and driver 110. Because pressure is low due to the low fluid flow, the driver piston 120 is not activated, and the driver 110 remains retracted. Similarly, the anchor 200 is not activated, and the anchor elements 210 remain retracted. Finally, the ram 240 is not activated and remains retracted.

Figure 3B:
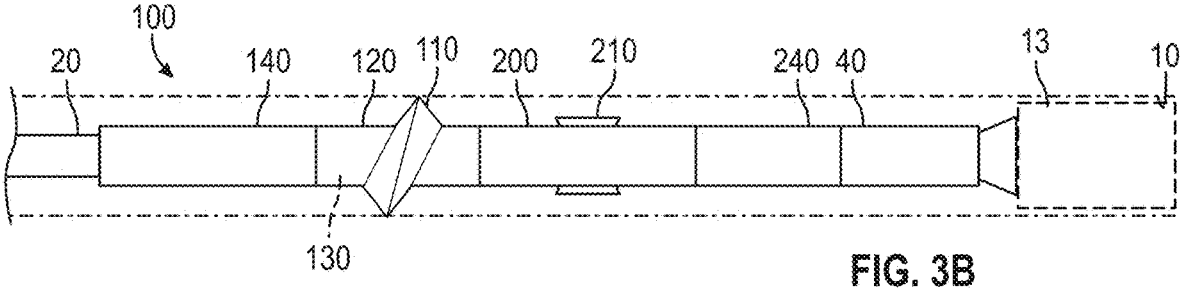

At some point during run-in, extended reach is required. An increase in fluid flow down the coil tubing string 20 activates the driver piston 120 to extend the driver 110 against the wellbore 10, which can have tubing or casing 12. The motor 140 continues to operate and rotates the driver 110 to wind the traction tool 100 along the wellbore 10. Eventually as shown in FIG. 3B, the traction tool 100 can reach a downhole component 13, feature, plug, etc. to be milled. Resistance at surface can indicate that the downhole component 13 has been reached.

Figure 3C:
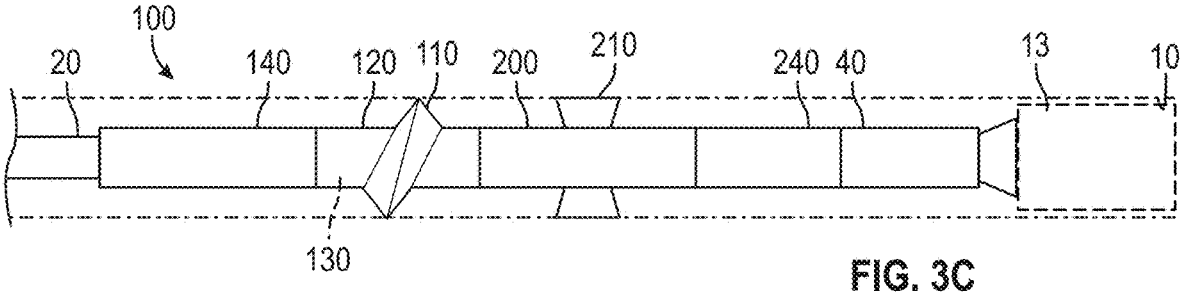

As shown in FIG. 3C, a further increase in fluid flow down the coil tubing string 20 activates the anchor 200 to extend the anchor elements 210 to engage in the wellbore 10. The motor 140 may still operate to rotate the driver 110. However, in response to high pressure levels and flow, the pressure relief valve (130) for the driver piston 120 may open so further force is not applied to the driver 110.

Figure 3D:
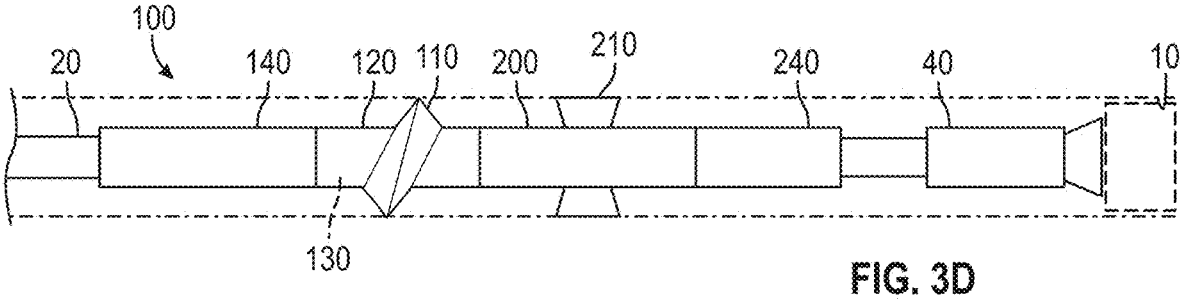

As then shown in FIG. 3D, an even further increase in fluid flow down the coil tubing string 20 activates the ram 240 to extend in the wellbore 10 from the anchor 200. The increased fluid flow operates the milling tool 40, which mills the downhole component 13 or a portion thereof depending on the reach of the ram 240 and the size of the downhole component 13. Reduction of the fluid flow allows the traction tool 100 to reset with the ram 240 and the anchor 200 retracting. Resumption can then be performed to advance the traction tool 100 and perform further milling.

C. Traction Tool

Looking at the traction tool 100 in more detail, FIGS. 4A-4G illustrate a cross-section of the traction tool 100 of the present disclosure in a run-in condition. The traction tool 100 is operable with fluid flow conducted to the traction tool 100 by the coiled tubing string (20) used deploy the traction tool 100. Overall, the traction tool 100 includes a tool body 101, a driver 110, a driver piston 120, a rotary drive or motor 140, and an anchor 200. In a further configuration as shown herein, the traction tool 100 also includes a ram 240.

The tool body 101 has a longitudinal axis A. Upper and lower subs or couplings on ends 102*a-b* of the traction tool 100 are used to connect the traction tool 100 to the coil tubing (20) and/or another tool, such as another traction tool or an operational downhole tool. For example, the tool body 101 connects at its uphole end 102*a* (FIG. 4A) to the coiled tubing string (20) (or other uphole tool), and the tool body 101 connects at its downhole end 102*b* (FIG. 4G) to a downhole tool (not shown), such as a milling motor or milling tool.

Figure 4A:
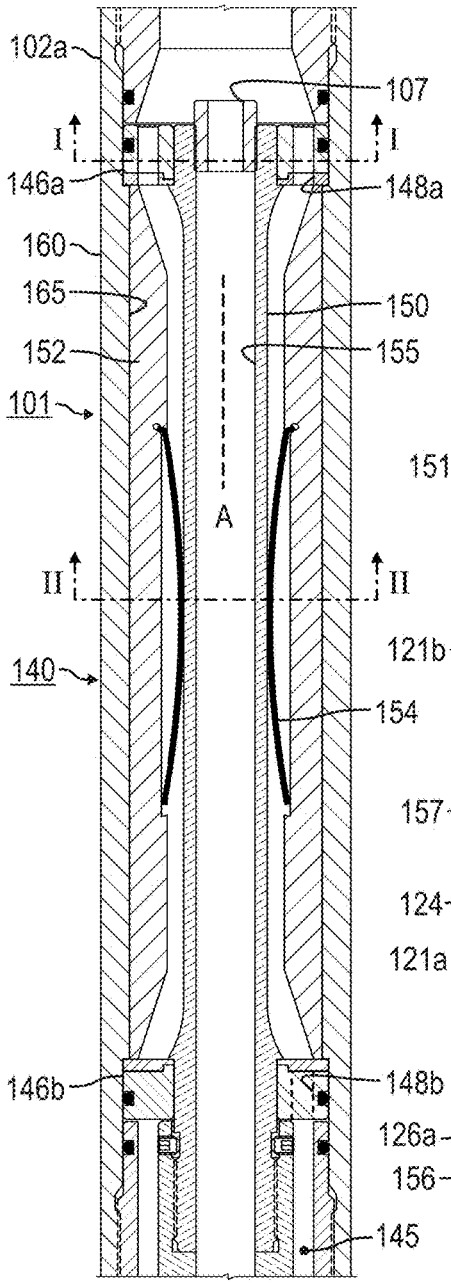

As shown in FIG. 4A, the motor 140 has a stator 160 and a drive shaft 150, which is rotatably disposed in the stator 160. The drive shaft 150 extends along the longitudinal axis and has a shaft bore 155 therethrough for passage of the fluid flow. During operation, the motor 140 is configured to impart a rotation to the drive shaft 150 about the longitudinal axis A in response to the fluid flow in an inner space 165 between the stator 160 and drive shaft 150.

Figure 4B:
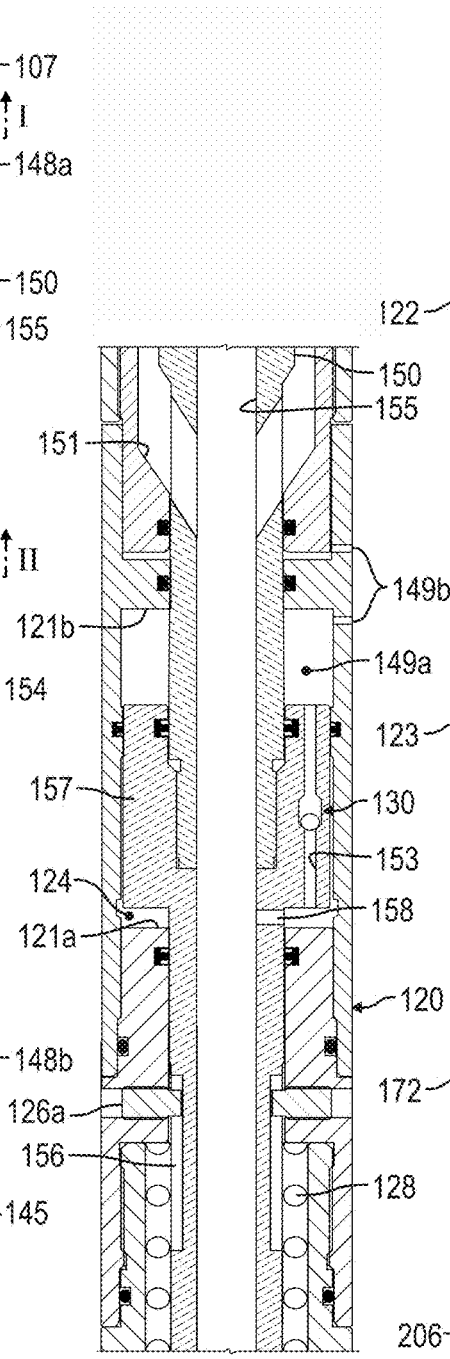
Figure 4C:
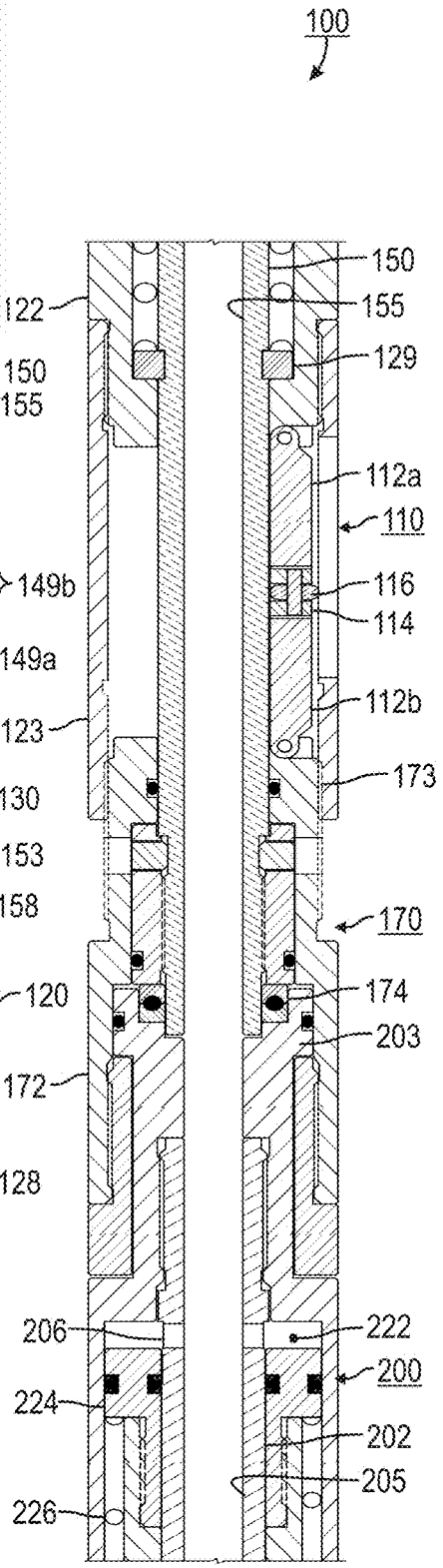

As shown in FIGS. 4B-4C, the driver piston 120 is disposed on the drive shaft 150 adjacent to the motor 140 and is rotatable with the rotation of the drive shaft 150. During operation, the driver piston 120 is movable with a first movement along the longitudinal direction in response to fluid flow communicated from the motor 140 to a piston chamber 124 of the driver piston 120. In response to the fluid flow, the driver piston 120 is configured to move the driver 110 between retracted and extended conditions.

As shown in FIG. 4C, the driver 110 is disposed on the drive shaft 150 adjacent to the driver piston 120 and is rotatable with the rotation of the drive shaft 150. The driver 110 is movable in response to the first movement of the driver piston 120. In particular, the driver 110 is movable between a retracted condition (as shown) and an extended condition (as discussed below) relative to the longitudinal axis A.

The driver 110 in the retracted condition is located close to the tool body 101 and is disengaged from the sidewall of the wellbore (10). The retracted condition can allow the traction tool 100 to pass through restrictions that may be present downhole. By contrast, the driver 110 in the extended condition is configured to engage inside the wellbore. For example, the driver 110 in the extended condition can engage against the sidewall of the wellbore (10). A portion of the driver 110 is arranged at an angle transverse to the longitudinal axis A. For example, one or more tracks 116 (e.g., wheels) disposed on the driver 110 can be arranged at the transverse angle to spiral along the wellbore (10) as the driver 110 is rotated.

As shown, the traction tool 100 can be operated with one driver piston 120, although two opposing driver pistons can be used on each side of the driver 110. In the present arrangement, the driver 110 has linkage arms 112, carriers 114, and wheels 116 movable between the retracted condition and the extended condition relative to the longitudinal axis A. Other arrangements can be used for the driver 110. For example, the traction tool 100 can be implemented using a segmented arrangement for the driver 110, such as described below with reference to FIG. 12A to FIG. 13B.

Figure 4D:
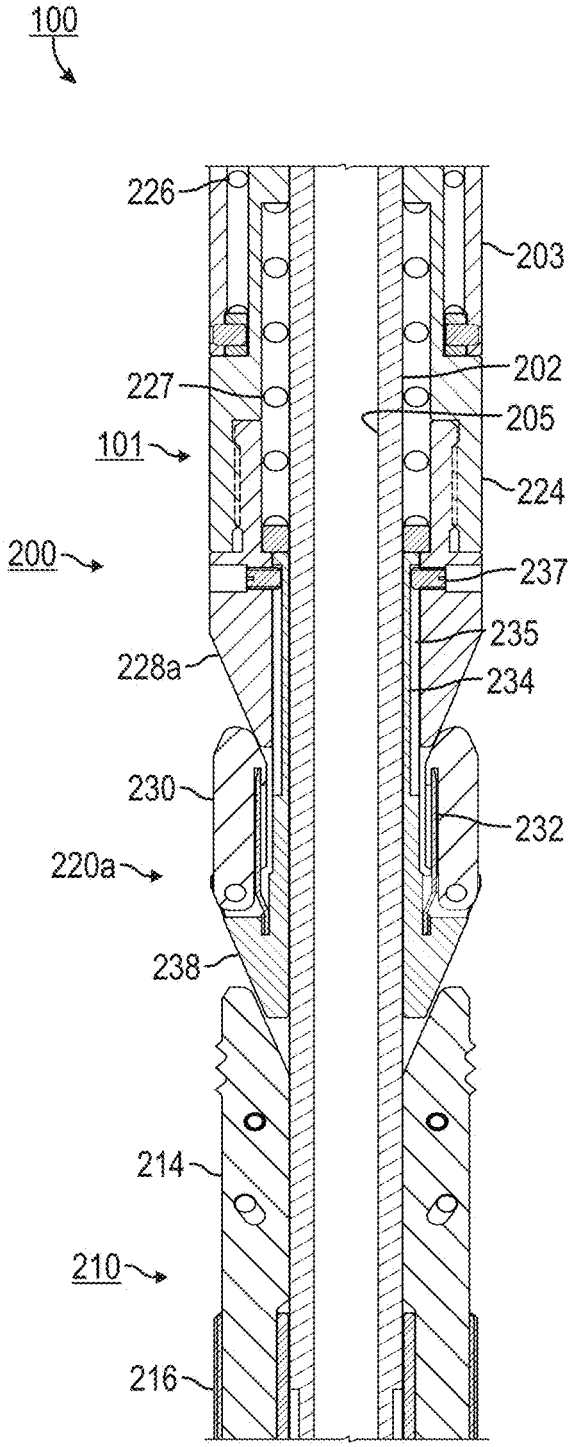

As shown in FIGS. 4C-4D, the anchor 200 is disposed adjacent to the driver 110 and is connected by a rotatable connection 170 to the drive shaft 150. Therefore, the anchor 200 does not rotate with rotation of the drive shaft 150 being rotated by the motor 140. The anchor 200 has a mandrel 202, one or more anchor elements 210, an anchor piston chamber 222, and an anchor piston 224. The mandrel 202 has a mandrel bore 205 that communicates with the shaft bore 155 of the drive shaft 150.

Hydraulic activation of the anchor piston 220 as discussed below actuates the one or more anchor elements 210 to engage against the sidewall of the wellbore (10). In the present arrangement, the one or more anchor elements 210 include a slip system. To actuate the slip system 210, the anchor piston 224 is movable with a second movement toward the slip system 210 in response to hydraulic (e.g., fluid) pressure communicated from the mandrel bore 205 of the mandrel 202 to the anchor piston chamber 222 via a port 206.

The slip system 210 in a retracted condition (FIGS. 4D-4E) is located close to the tool body 101 and is disengaged from the sidewall of the wellbore (10). In response to the second movement of the anchor piston 224, however, the slip system 210 is movable from the retracted condition (FIGS. 4D-4E) to an extended condition (as discussed below). The slip system 210 in the extended condition is configured to engage with the wellbore (10).

Figure 4E:
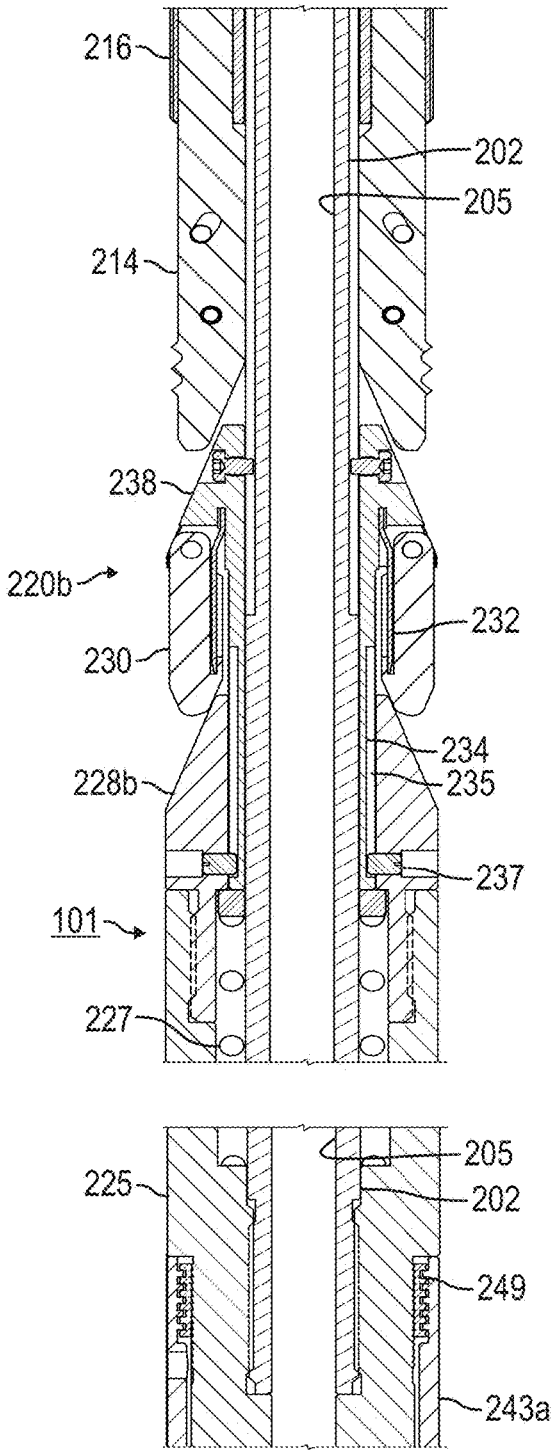
Figure 4F:
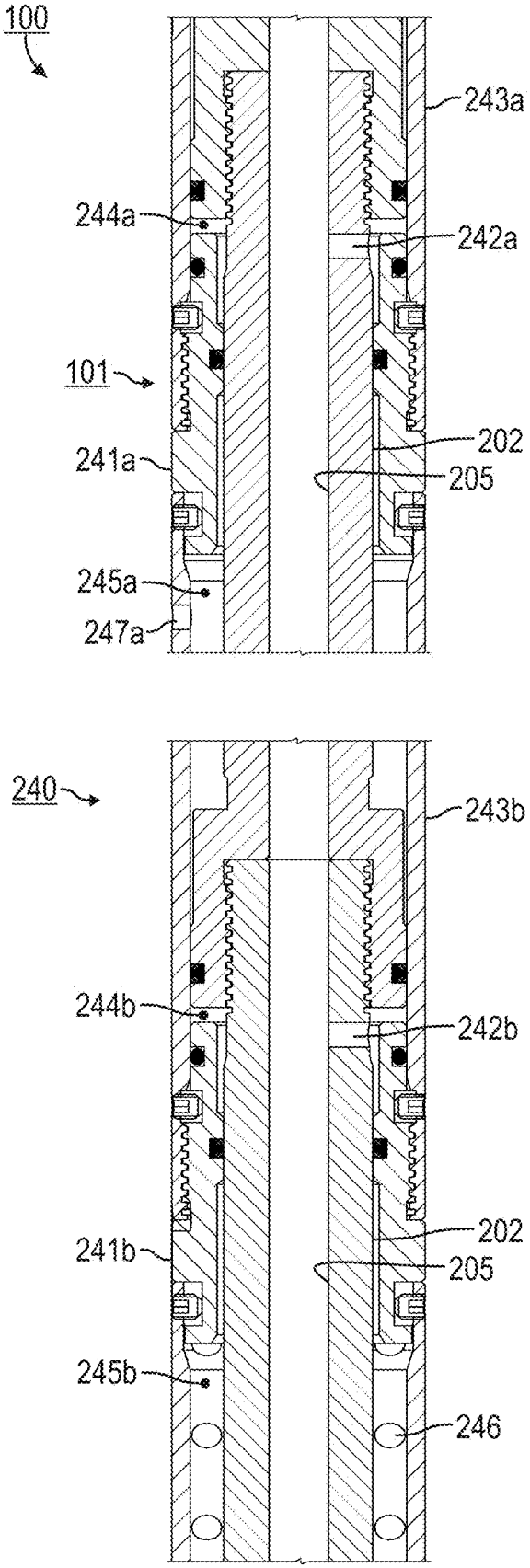
Figure 4G:
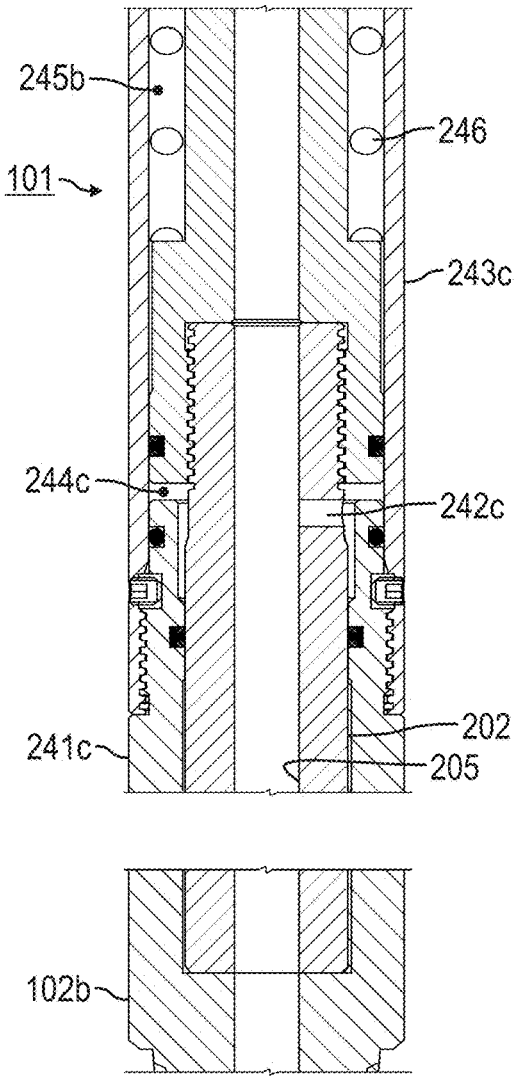

As shown in FIGS. 4F-4G, the traction tool 100 further includes a ram 240 disposed adjacent the anchor 200. The ram 240 has a plurality of ram pistons 241*a-c* and ram arms 243*a-c* that can extend along the mandrel 202 of the traction tool 100. As shown here, the ram 240 includes three ram pistons 241*a-c* and ram arms 243*a-c* in this configuration, but more or less could be used. At least one of the ram piston 241*b* includes a biasing element or spring 246.

Hydraulic activation of the anchor pistons 241*a-c* as discussed below actuates the ram arms 243*a-b* to extend on the mandrel 202 along the longitudinal axis A of the traction tool 100. During operation, for example, the ram pistons 241*a-c* and arms 243*a-c* are extendable along the longitudinal axis of the mandrel 202 in response to hydraulic (e.g., fluid) pressure communicated from the mandrel bore 205 to ram piston chambers 244*a-c* via ports 242*a-c* in the mandrel 202. Extension of the ram pistons 241*a-c* and connected arms 243*a-c* moves the downhole coupling on the end 102*b* (FIG. 4G) of the tool body 101, which can connect to a downhole tool (such as a milling tool).

Hydraulic activation of the motor 140, the driver piston 120, the driver 110, the anchor 200, and the ram 240 can be implemented in stages. During operation of the traction tool 100, for example, the motor 140 rotates the driver 110 in response to fluid flow through the motor 140. The driver 110 is then movable in response to a first level of hydraulic (e.g., fluid) pressure overcoming a first bias (e.g., spring 128) of the driver 110 so the driver 110 can engage inside the wellbore tubing. (During operation, as discussed in more detail below, the force from hydraulic pressure on the driver piston 120 can be stopped, relieved, or otherwise reduced by the pressure relief valve 130 (FIG. 4A) when a high-pressure level is reached that opens the pressure relief valve 130.)

In response to a second level of hydraulic pressure overcoming a second bias (e.g., spring 226, 227) of the anchor 200, The anchor 200 is then movable to engage inside the wellbore (10). Finally, the ram pistons 241*a-c* and arms 243*a-b* are extendable in response to a third, even higher level of hydraulic pressure in the ram piston chambers 244*a-b* overcoming a third bias (e.g., spring 246) of the ram 240.

Figure 5:
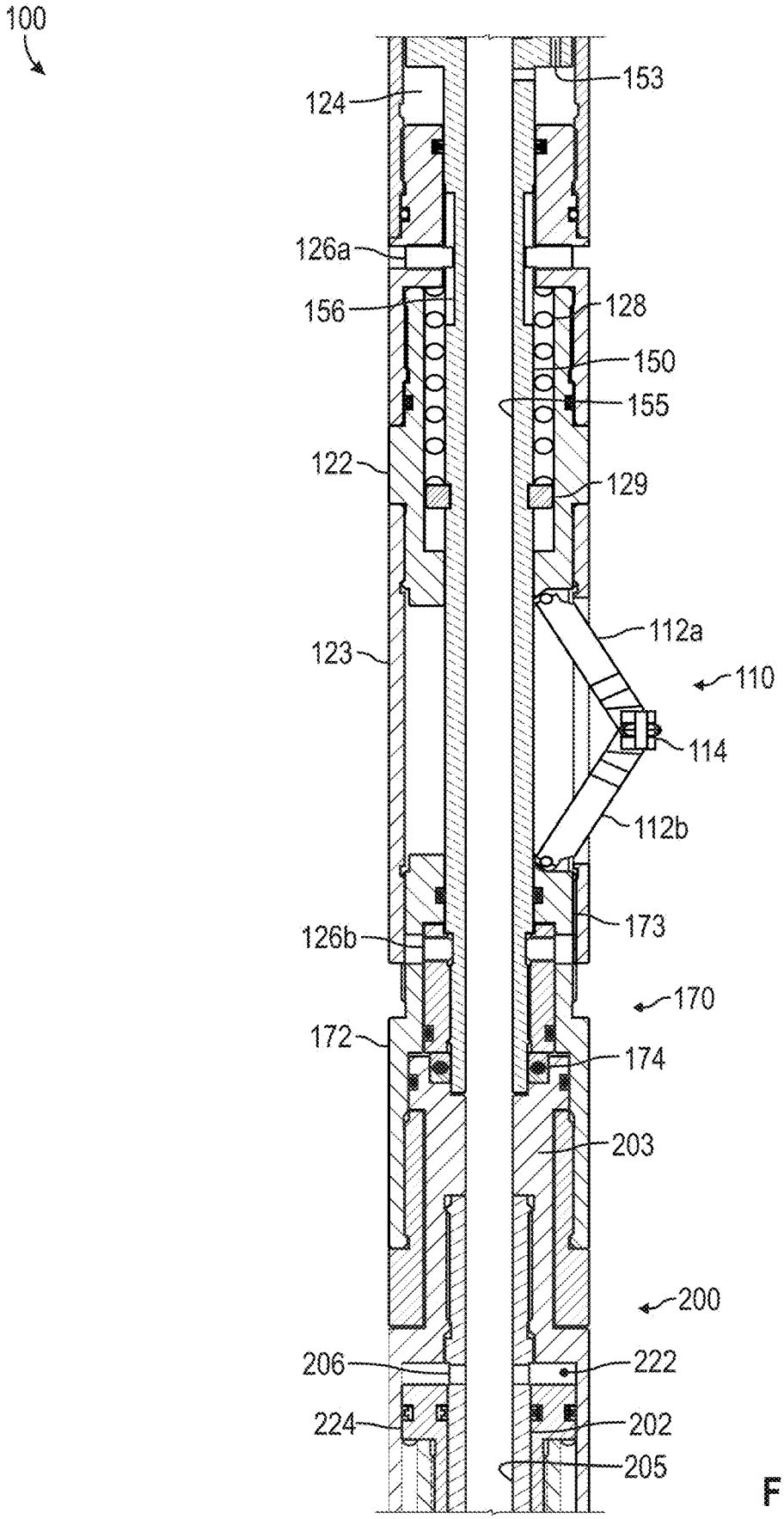
FIG. 5 illustrates the driver of the traction tool in an engaged condition.
Figure 6A:
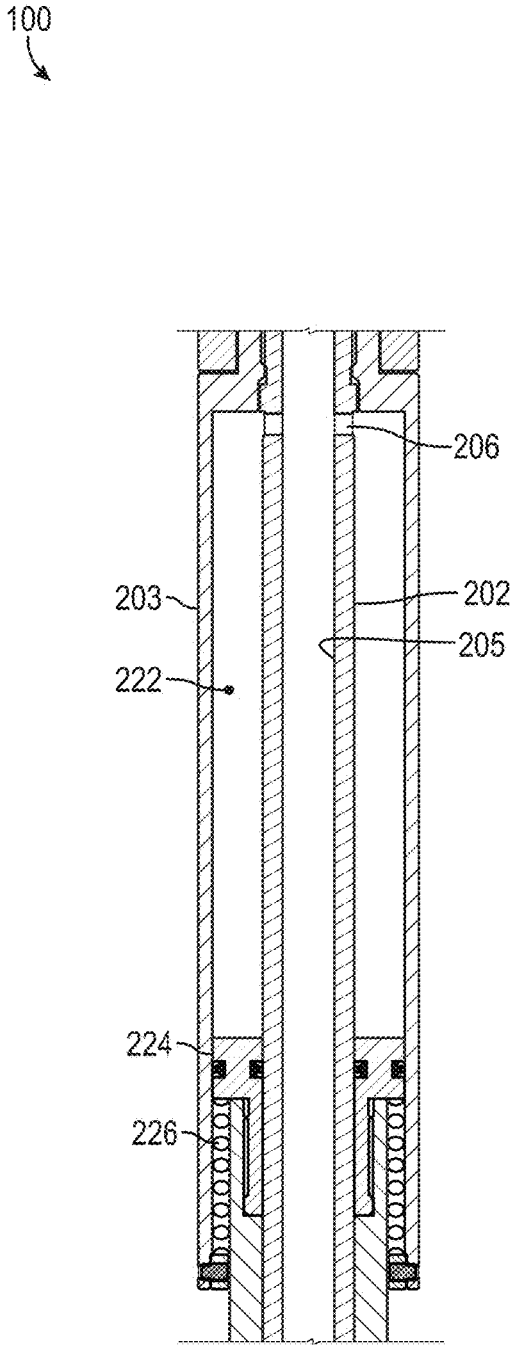
FIGS. 6A-6B illustrate the anchor of the traction tool in an extended condition.
Figure 6B:
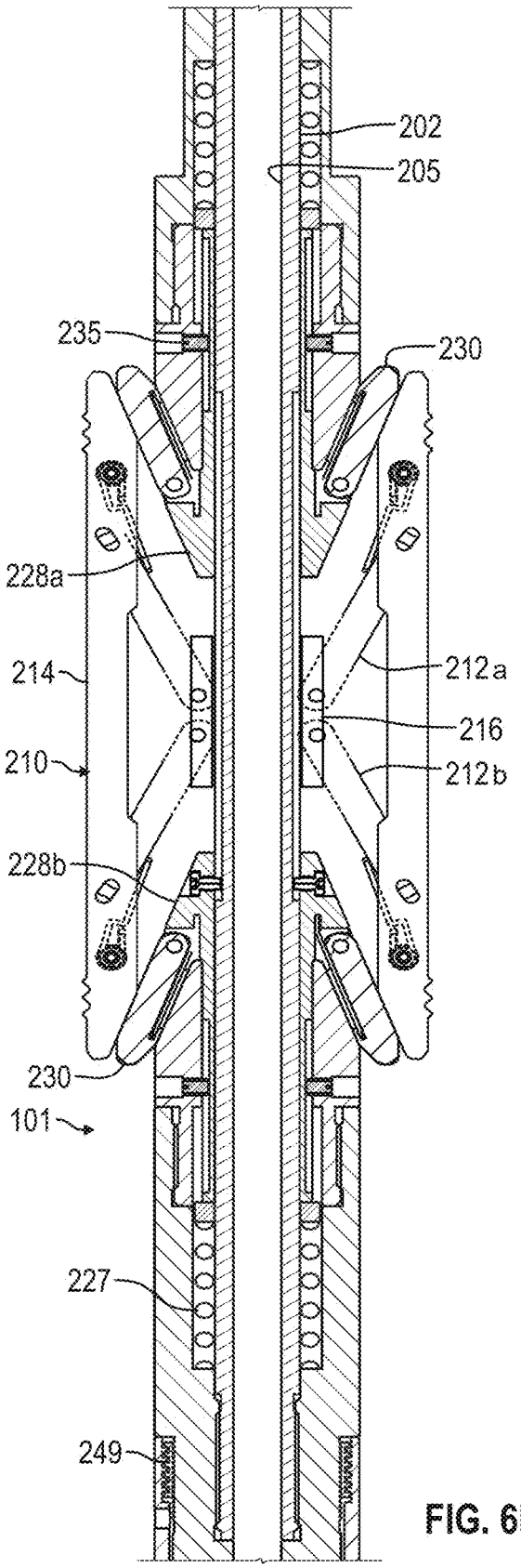
Figure 7A:
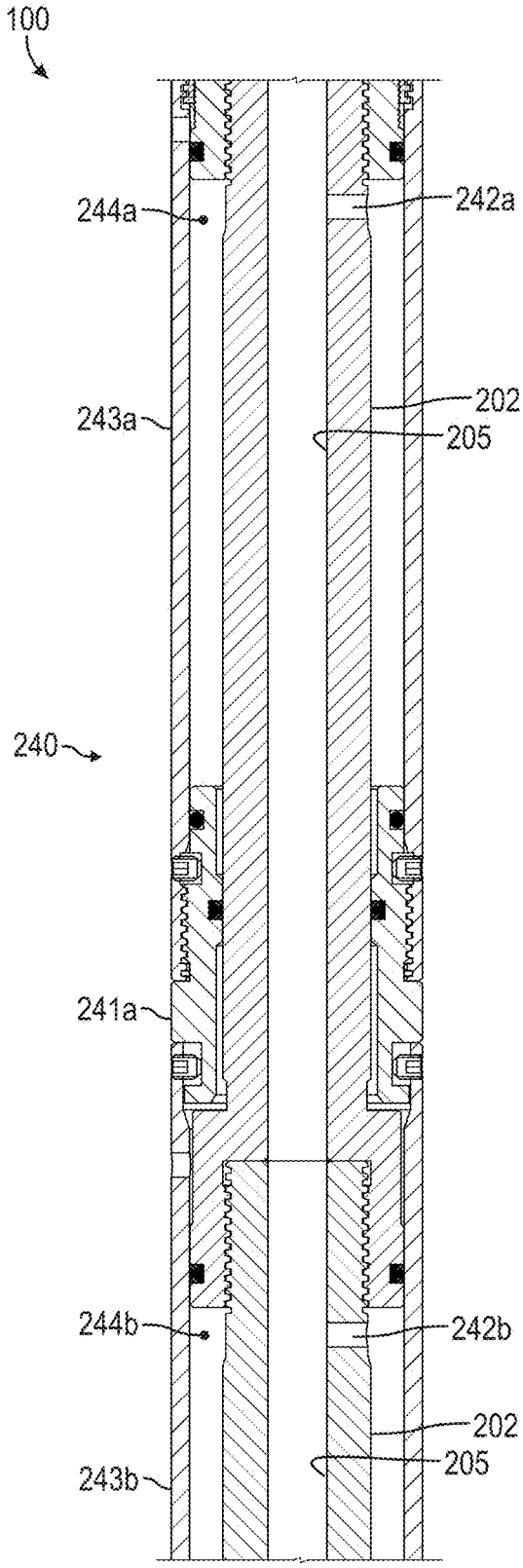
FIGS. 7A-7B illustrate the ram of the traction tool in an extended condition.
Figure 7B:
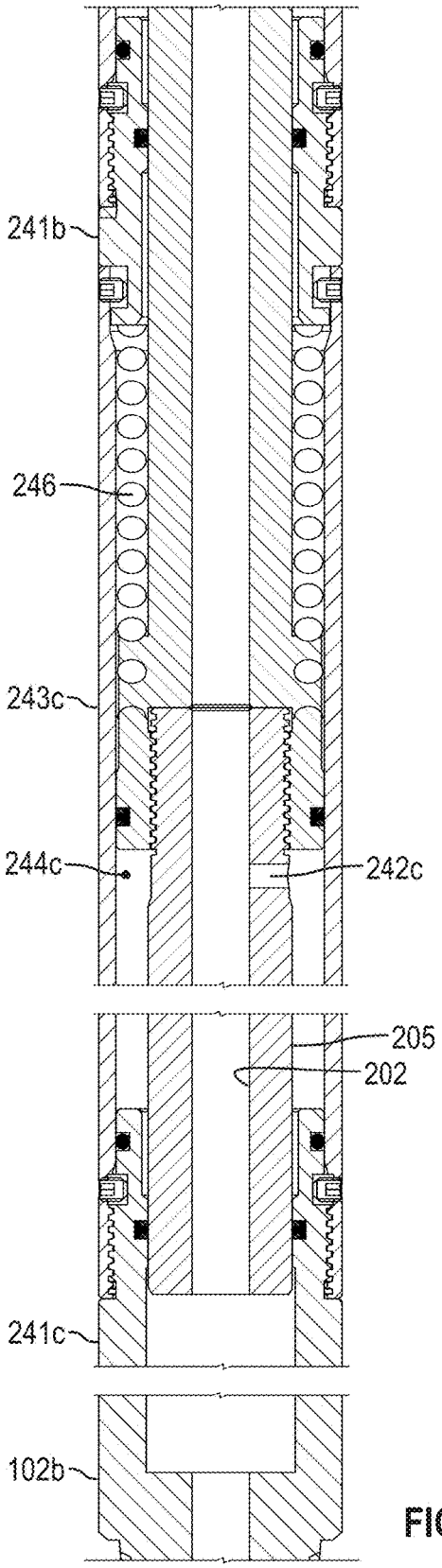

Briefly, the driver 110 is first activated as shown in FIG. 5 in response to a first level of hydraulic pressure overcoming a first bias (e.g., bias of spring 128) of the driver 110. The anchor 200 is then activated as shown in FIG. 6A-6B in response to a second level of hydraulic pressure overcoming a second bias (e.g., bias of springs 226, 227) of the anchor 200, where the second level is greater than the first level. Finally, the ram 240 is activated as shown in FIGS. 7A-7B in response to a third level of hydraulic pressure overcoming a third bias (e.g., bias of spring 246) of the ram 240, wherein the third level is greater than the first level.

1. Motor

Looking at the motor 140 in more detail as shown in FIG. 4A, the motor 140 includes a stator 160 and a drive shaft or rotor 150. In this instance, the drive shaft 150, which is turned, is disposed inside the stator 160. For its part, the drive shaft 150 includes a shaft bore 155 therethrough to communicate with the fluid flow from uphole to the mandrel's bore 205 downhole. The shaft bore 155 of the drive shaft 150 can include an orifice or restriction 107 configured to produce a pressure differential in the bore 105 upstream of the restriction 107. FIG. 4A illustrates one configuration for the pressure restriction 107 in the drive shaft 150 of the traction tool 100. Such a distinct restriction 107 may not be necessary in some implementations because the pressure differential can be achieved in the fluid flow through the drive shaft 150 by virtue of another component.

The drive shaft 150 and the stator 160 define fluid chambers 142 in the inner space 165 or annulus between them. The fluid chambers 142 can be selectively placed in fluid communication with an inlet and an outlet for the fluid flow so that selective pressure in the fluid chambers 142 can cause the drive shaft 150 to rotate relative to the stator 160.

Figure 8:
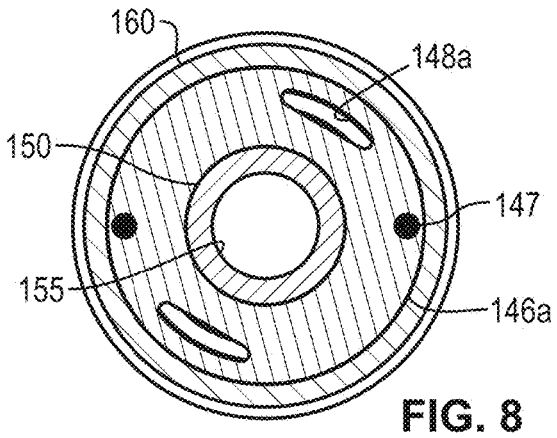
FIG. 8 illustrates an end-section of the portion of the traction tool in FIG. 4A taken along lines I-I.
Figure 9A:
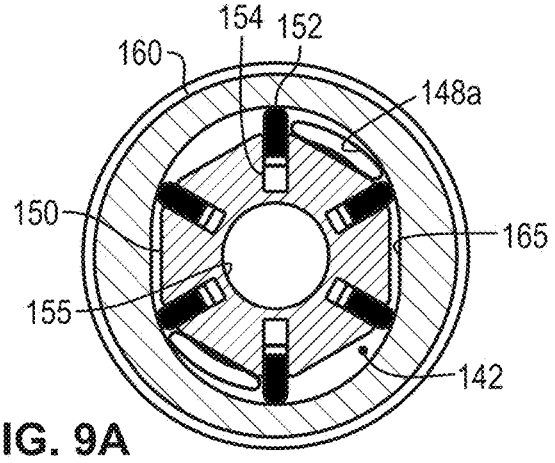
FIG. 9A illustrates an end-section of the portion of the traction tool in FIG. 4A taken along lines II-II.
Figure 9B:
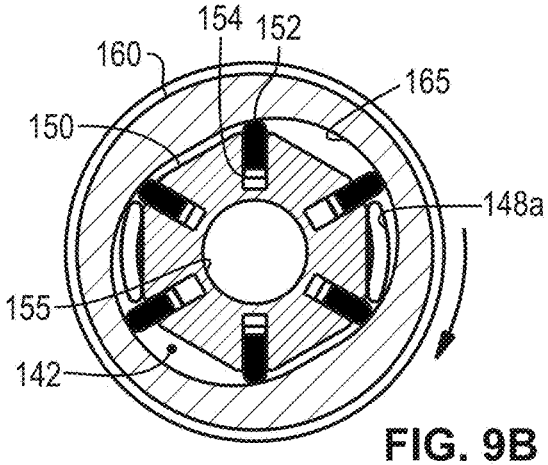
FIG. 9B illustrates an end-section of the portion of the traction tool in FIG. 4A taken along lines II-II when the drive housing has rotated.

The arrangement between the drive shaft 150 and the stator 160 is shown in the cross-section of FIG. 4A and in the end-sections of FIG. 8 and FIGS. 9A-9B. As shown, the stator 160 is a cylindrical housing that has an inner passage in which the drive shaft 150 is disposed and forms an inner space 165 therewith. The inner passage is not simply cylindrical. Instead, being oblong, oval, elliptical, or the like, the inner passage defines lobes of the inner space 165.

The drive shaft 150 has a plurality of vanes 152 disposed thereabout. The vanes 152 are biased to engage against the inner space 165 of the stator 160 to define the fluid chambers 142 of the motor 140. The drive shaft 150 is generally cylindrical and is shown here as being octagonal. More or less sides of the drive shaft 150 and number of vanes 152 can be provided. The vanes 152 are disposed in pockets in the sides of the drive shaft 150 and are biased by biasing elements, such as leaf springs 154, to extend toward the inside surface of the stator 160.

As best shown in FIG. 4A, plate valves 146*a-b* are used to selectively communicate the fluid flow for the motor 140. Fluid flow communicates with an intake plate valve 146*a*, which controls the fluid flow to the chambers 142 formed between the stator 160 and the drive shaft 150 of the motor 140. Fluid flow from the chambers 142 passes through an exhaust plate valve 146*b*, which controls the exhaust of the fluid flow from the chambers 142. The exhausted fluid flow then communicates back into the shaft bore 155 through cross ports 151.

Both of the plate valves 146*a-b* have orifices 148*a-b*. The uphole intake plate valve 146*a* is visible in FIG. 8. The orifices 148*a* define the inlet for the fluid chambers (142) between the stator 160 and the drive shaft 150. As shown in FIG. 4A, the downhole exhaust plate valve 146*b* also has orifices 148*b*, which are offset from the inlet orifices 148*a* and define the outlet for the fluid chambers (142) between the stator 160 and the drive shaft 150. The plate valves 146*a-b* are fixed with the stator 160. As shown in FIG. 8, for example, pins 147 can connect the intake plate valve 146*a* to the stator 160. (The exhaust plate valve 146*b* can be similarly connected by pins to the stator 160).

2. Piston

Looking at the driver piston 120 as shown in FIGS. 4A-4C in more detail, the traction tool 100 of this embodiment includes the driver piston 120 disposed on one side of the driver 110. The piston 120 has a piston housing 122, which can be made up of two or more housing portions for assembly purposes. The piston housing 122 is rotatable with the drive shaft 150 using pins 126*a* engaged in longitudinal slots 156 on the outside of the drive shaft 150.

An end 123 of the piston housing 122 engages with a spline connection 173 to a rotatable collar 172 of the rotatable connection 170 of the traction tool 100. The piston housing 122 forms a piston chamber 124 with the drive shaft 150, and the piston housing 122 can rotate by the pins 126*a* and slots 156 with the drive shaft 150. The piston chamber 124 is disposed in fluid communication via a relief port 153 in the drive shaft 150.

When activated and deactivated, the piston housing 122 is movable in a longitudinal direction relative to the driver 110. One set of linkage arms 112*a* of the driver 110 is connected to the piston housing 122 of the driver piston 120, and another set of linkage arms 112*b* of the driver 110 is connected to the rotatable collar 172 of the rotatable connection 170. When pushed, the linkage arms 112*a-b* are configured to extend and retract the carriers 114 that carry the angled wheels 116 of the driver 110.

A spring 128 is engaged between the piston housing 122 and a retainer 129 disposed on the drive shaft 150. The spring 128 biases the piston housing 122 in a longitudinal direction relative to the drive shaft 150 and is configured to urge the driver 110 to the retracted condition.

3. Pressure Relief Valve

As noted above, the pressure relief valve 130 is used in a relief port 153, which is defined in a dividing portion 157 of the drive shaft 150. During operation, the pressure relief valve 130 can control fluid flow and pressure for the driver piston 120. In particular, a side port 158 in the drive shaft 150 communicates fluid pressure from the shaft bore 155 to the piston chamber 124. The pressure relief valve 130 is normally closed so the pressure can concentrate in the piston chamber 124.

At some predetermined level, the pressure relief valve 130 opens and communicates the piston chamber 124 with a relief chamber 149*a* through the relief port 153. As shown, the piston chamber 124 is a sealed volume, being sealed by sealing elements between the driver piston 120 and the drive shaft 150. The relief chamber 149*a* is also a sealed volume, being sealed by sealing elements between the driver piston 120 and the drive shaft 150. External ports 149*b* communicate the relief chamber 149*a* outside of the traction tool 100 to prevent fluid lock when the driver piston 120 is moved.

During operation, for example, opening of the pressure relief valve 130 can stop, relieve, or otherwise reduce the force exerted on the driver piston 120. As the fluid flow/pressure inside the shaft bore 155 of the drive shaft 150 enters the piston chamber 124 via the side port 158, the pressure acts on the first piston surface 121*a*, resulting in longitudinal movement of the driver piston 120 on the drive shaft 150 to actuate the driver 110. When the fluid pressure in the piston chamber 124 reaches a predetermined threshold that is high enough, the pressure relief valve 130 opens, relieving pressure from the piston chamber 124 to the opposite relief chamber 149*a*. Eventually, the piston chamber 124 and the relief chamber 149*a* can equalize.

When fluid/pressure is relieved through the pressure relief valve 130, the pressures in the two chambers 124, 149*a* act in opposing directions on the opposing piston surfaces 121*a-b*. Force on the driver piston 120 decreases as an equalized pressure is reached in the two chambers 124, 149*a*. Without the piston force being produced, the driver 110 no longer exerts a radial force against the sidewall of the wellbore (10). This can prevent the driver 110 from being active while drilling and other operations disclosed herein are performed.

The pressure relief valve 130 can have any suitable construction. For instance, the pressure relief valve 130 can be spring-loaded and normally closed, being set to open in response to a high level of pressure in the pressure chamber 124. Alternatively, the pressure relief valve 130 can be a poppet valve that is pushed open and closed by fluid pressure across the poppet. In other examples, the pressure relief valve 130 can use a burst disc, a rupture disc, a shear pined valve, or the like that is set to burst, rupture, or shear open in response to a set pressure level.

In another implementation, such a pressure relief valve 130 may not be used. Instead, the pressure relief for the valve 130 can operate as a throttle in the relief port 153 and configured to throttle the fluid flow from the piston chamber 124 to the relief chamber 149*a*. These and other configurations can be used.

Figure 10:
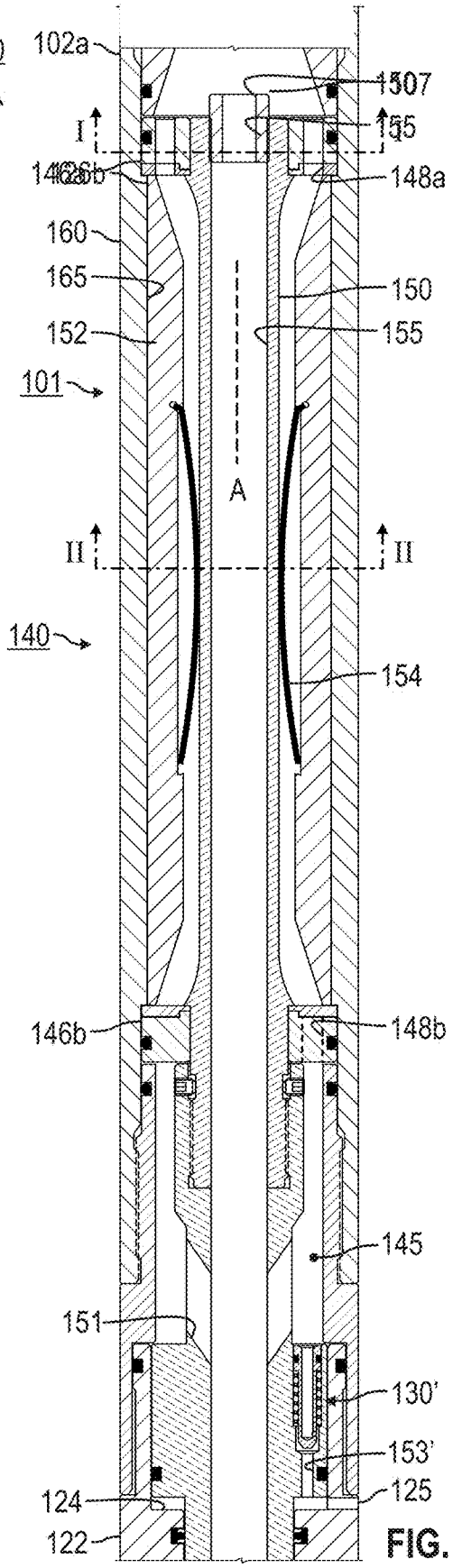
FIG. 10 illustrates a cross-section of a portion of the disclosed tracking tool having an alternative configuration.

Furthermore, a different type of valve arrangement may be used. For example, as shown in FIG. 10, a control valve 130' can be disposed in an inlet port 153' between an inlet area 145 and the piston chamber 124 for the driver piston (120). The control valve 130' is configured to control the fluid flow to the piston chamber 124. In this configuration, the inlet port 153' having the control valve 130' communicates with the inlet area 145 of the motor 140, where fluid from the inner space 165 of the motor 140 can return to the shaft bore 155 of the drive shaft 150. Hydraulic pressure in the inlet area 145 of the motor 140 passes through the control valve 130' and the inlet port 153' and enters the piston chamber 124 of the driver piston 120 to actuate the driver (110) (e.g., to extend the arms (112*a-b*), the carriers (114), and the drive wheels (116)).

When pressure of the fluid flow in the inlet area 145 overcomes the bias of the control valve 130', the piston chamber 124 fills with pressurized fluid, and the piston housing 122 moves longitudinally along the drive shaft 150. (A relief outlet 125 defined in the piston housing 122 can exhaust excess hydraulic pressure from the piston chamber 124 by throttling release of the fluid pressure in the piston chamber 124). The movement of the piston housing 122 in turn causes the driver 110 to move laterally between the retracted and extended conditions, as discussed above.

Opening of the control valve 130' can be set to a predetermined pressure threshold and can be configured for any desired implementation, as necessary. The control valve 130' can close due to the increase of the pressure above the predetermined threshold. Excess pressure in the piston chamber 124 can be relieved out of the relief outlet 125 in the piston housing 122.

Figure 11A:
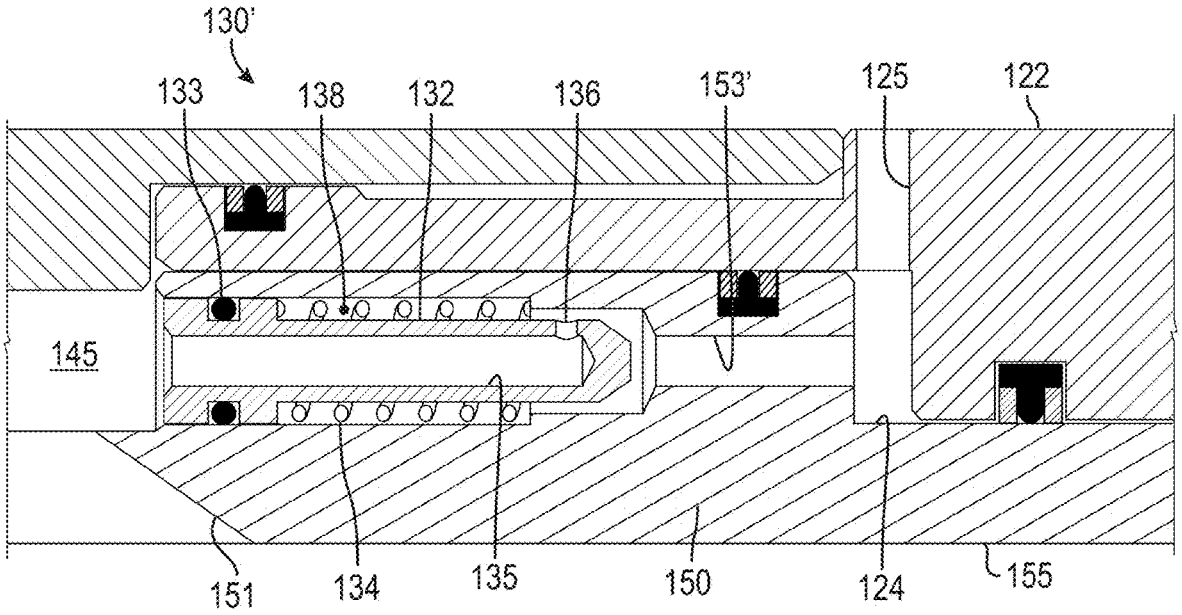
FIGS. 11A-11B illustrate details of a valve respectively in an opened position and a closed position.
Figure 11B:
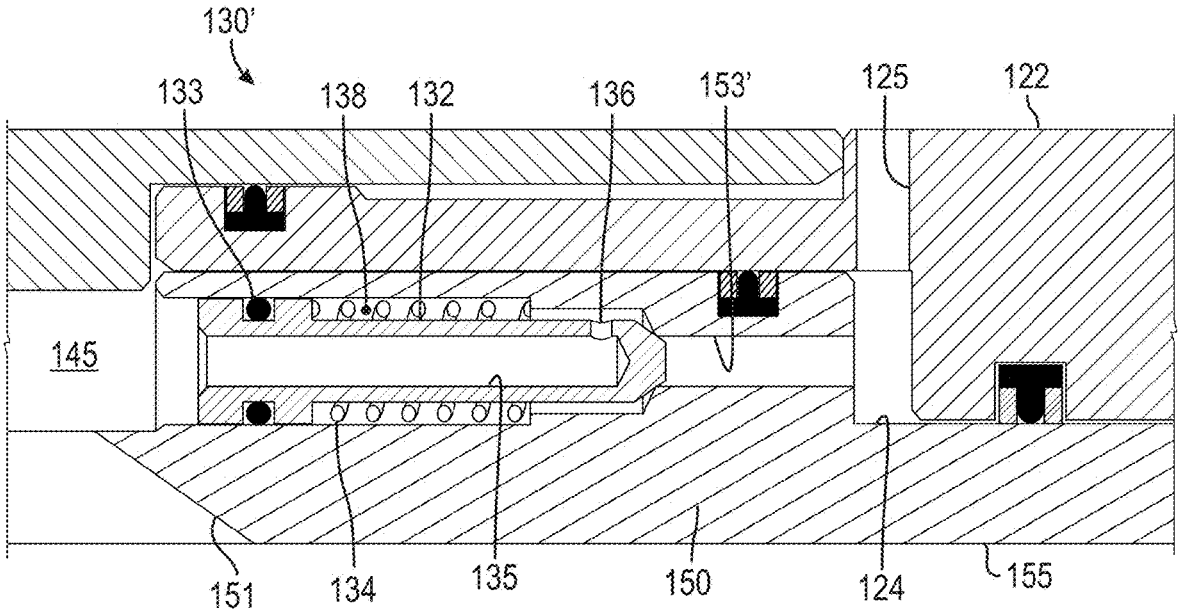
Figure 12A:
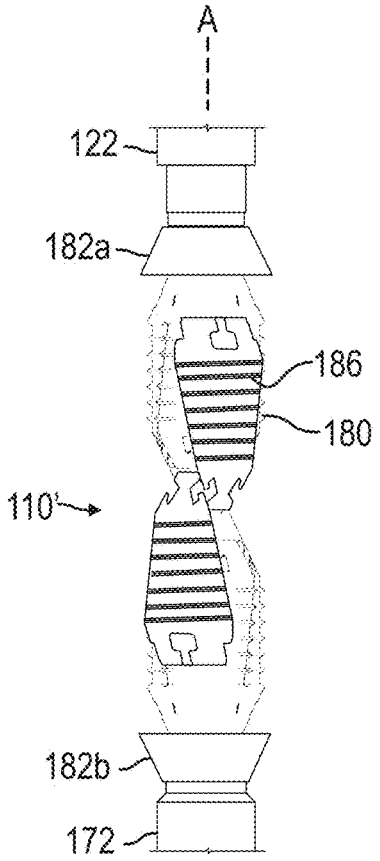
FIGS. 12A-12B illustrate another driver for a traction tool of the present disclosure in a disengaged condition.
Figure 12B:
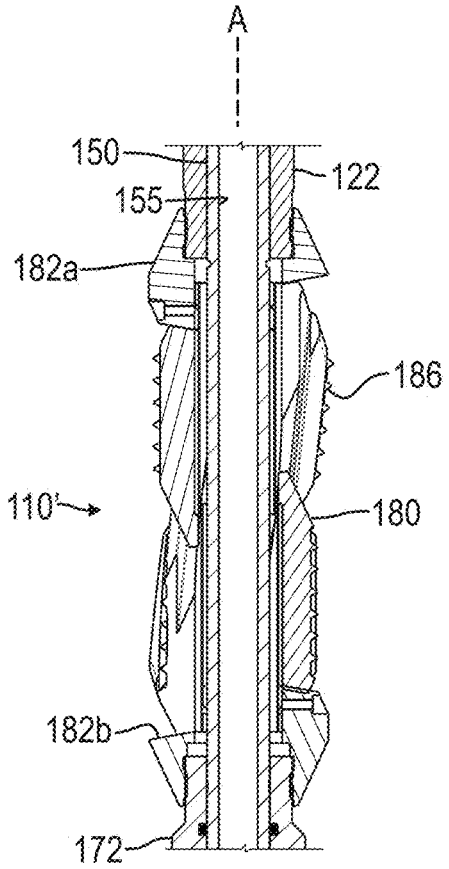
Figure 13A:
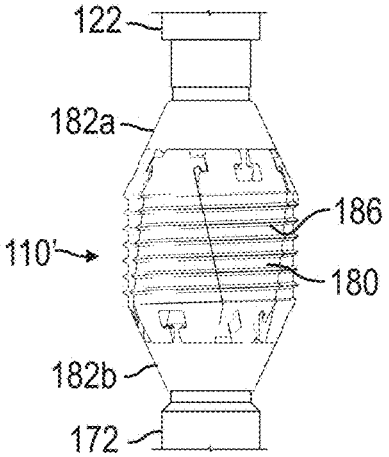
FIGS. 13A-13B illustrate the driver of FIGS. 12A-12B in an engaged condition.
Figure 13B:
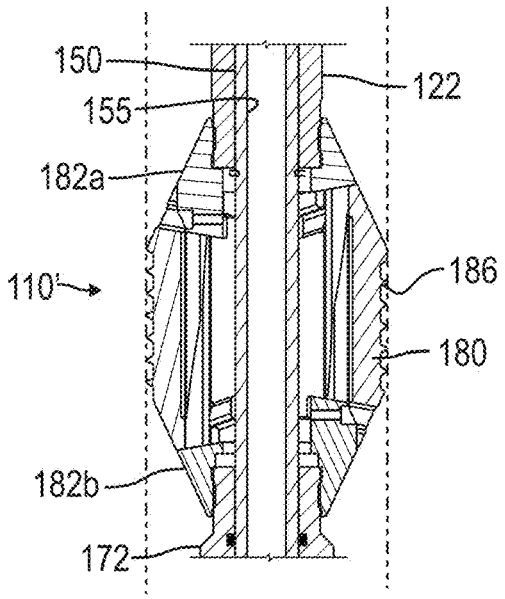

Additional details of the control valve 130' are shown in FIGS. 11A-11B. The control valve 130' is shown in an opened position in FIG. 11A and in a closed position in FIG. 11B. The control valve 130' is normally opened and can be kept open for a certain threshold of flow. The control valve 130' can then be closed by increasing pressure of the fluid flow to a predetermined threshold.

The control valve 130' as shown is a check valve, such as a poppet valve. In the present arrangement, the control valve 130' includes a poppet 132 that is biased to an opened condition by a spring 134 in the drive shaft's inlet port 153'. Input fluid flow can pass from the inlet area 145 to a passage 135 in the poppet 132. The input fluid flow can then pass out an orifice 136 into a poppet chamber 138 on the other side of a seal 133 on the poppet 132. When differential pressures on the poppet 132 do not exceed the bias on the poppet 132, the poppet 132 is (or remains) unseated as shown in FIG. 11A, and the fluid flow can pass through the inlet port 153' to the piston chamber 124.

When differential pressures on the poppet 132 does exceed the bias on the poppet 132, the poppet 132 is seated, and the fluid flow cannot pass through the inlet port 153' to the piston chamber 124. Essentially, at this point when the fluid flow is increased beyond a certain threshold, no additional piston force is produced by the driver piston (120) on the driver (110) because additional volume of the piston chambers 124 cannot be filled.

4. Driver

Looking at the driver 110 in FIG. 4C in more detail, the driver 110 includes a plurality of carriers 114 disposed about the longitudinal axis A. Each carrier 114 is hingedly connected to opposing linkage arms 112*a-b*. In turn, the linkage arms 112*a-b* are hingedly connected between portions of the traction tool 100. In particular, first linkage arms 112*a* are connected to the piston housing 122, and second linkage arms 112*b* are connected to the rotatable collar 172 of the rotatable connection 170.

The tracks 116 are disposed on the carriers 114. In this arrangement as already noted, the tracks 116 include wheels rotatably disposed on the carriers 114. These wheels 116 as noted are arranged at an angle transverse to the longitudinal axis A. As the wheels 116 engage inside the sidewall of the wellbore (10) and as the driver 110 is rotated, the wheels 116 thread, wind, or spiral along the sidewall, tending to move the traction tool 100 in the wellbore 10. The contour or shape of these wheels 116 can be configured to engage the sidewall of the surrounding tubing. For example, the wheels 116 can have a rounded edge, or the wheels 116 can include a bladed edge. The wheels 116 can include a friction coating. These and other possibilities can be used to facilitate the engagement of the wheel with the surrounding tubing. Preferably, the engagement of the wheels 116 does not tend to score or bite into the tubing surface to a detrimental extent.

5. Anchor

Looking at the anchor 200 in FIGS. 4C-4E and FIGS. 6A-6B in more detail, the anchor piston 224 is in communication via a port 206 with the mandrel bore 205 of the mandrel 202, which extends along the length of the traction tool 100. Fluid communicated through the port 206 enters the anchor piston chamber 222 so hydraulic pressure can move the anchor piston 224 along the mandrel 202 against the bias of a biasing element or spring 226. Movement of the anchor piston 224 moves a cone arrangement 220*a* toward the slip system 210, which can move against an opposing cone arrangement 220*b*. The cone arrangements 220*a-b* can be counter-biased by biasing elements or springs 227.

The slip system 210 includes linkage arms 212*a-b* (FIG. 6B), slip elements 214, and a holder 216. The holder 216 is mounted to move along the mandrel 202. The linkage arms 212*a-b* connect the slip elements 214 to the holder 216 and allow the slip elements 214 to extend and retract relative to the mandrel 202. Should further extension be necessary, a given implementation of the slip system 210 and the cone arrangements 220*a-b* can include primary ramps 228*a-b*, extension flaps 230, and extension ramps 238, such as shown in the present example. In particular, the first cone arrangement 220*a* includes a first primary ramp 228*a* and an extension ramp 238. The first primary ramp 228*a* is fixedly connected to the anchor piston 224. The extension ramp 238 is slidably connected to the first primary ramp 228*a*. Extension flaps 230 are hingedly connected to the extension ramp 238. The first primary ramp 228*a* is moveable with the movement of the anchor piston 224, and the extension flaps 230 are rotatable outward in response to engagement with the first primary ramp 228*a*. The extension ramp 238 is moveable against the end of the slips 214 in response to the movement of the first primary ramp 228*a*. The second cone arrangement 220*b* can be similarly configured.

Movement of the anchor piston's cone arrangement 220*a* toward the opposing cone arrangement 220*b* on the other side of the slip system 210 causes the extension flaps 230 to pivot outward. The slip elements 214 are thereby wedged between the extension ramps 238 and the flaps 230 to engage toward the wellbore sidewall. As shown, the opposing ramp 228*b* can also be counter-biased by a biasing element or spring 229.

The extension flaps 230 can be biased inward by leaf springs 232. Each of the extension ramps 238 can have a sleeve 234 that can move along the mandrel 202. Rotation and movement of the sleeves 234 can be controlled by pins 235 engaged in longitudinal slots 237 of the sleeves 234.

6. Ram

Looking at the ram 240 of FIGS. 4F-4G and FIGS. 7A-7B in more detail, the ram 240 includes ram pistons 241*a-c* and ram arms 243*a-c* with piston chambers 244*a-c* in communication via ports 242*a-c* with the mandrel bore 205. As shown, the ram arms 243*a-c* are sleeves connected to the ram pistons 241*a-c*. (As shown in FIG. 4E, the upper end of the first ram arm 243*a* can be connected by a body lock ring 249 to a lower collar 225 of the anchor 200.) Fluid communicated through the ports 242*a-b* enters the piston chambers 244*a-b* so hydraulic pressure can move the ram pistons 241*a-c* and arms 243*a-c* along the mandrel 202 against the bias of at least one biasing element or spring (namely the spring 246 on the ram arm 243*b*). Each of the ram arms 243*a-c* can also define an equalizing chamber with the mandrel 202. For example, FIG. 4F shows an equalizing chamber 245*a*, which has an equalizing port 247*a* communicating outside the traction tool 100. When the ram 240 is activated, the ram pistons 241*a-c* and arms 243*a-c* move the downhole coupling on the end 102*b* (FIG. 4G) of the traction tool 100, and fluid from the mandrel bore 205 can pass out of the passage in the downhole coupling.

D. Operation

Having an overview of the traction tool 100, discussion now turns to its operation. As noted previously, the traction tool 100 is shown in the run-in condition in FIGS. 4A-4G. The uphole coupling at uphole end 102*a* connects to uphole components of the system (e.g., coil tubing string, etc.) and to the surface. The downhole coupling at downhole end 104*b* connects to downhole components of the system (e.g., milling tool, etc.).

During operation, the traction tool 100 is deployed on coiled tubing string (20) in the wellbore (10). The motor 140 on the traction tool 100 is operated using the fluid flow communicated from the coiled tubing string (20), and rotation of the motor 140 is transferred to rotating the driver 110 disposed on the traction tool 100. When needed, the tracks 116 on the rotating driver 110 can be selectively engaged against the wellbore (10) by operating the driver piston 120 and moving the rotating driver 110 from the retracted condition to the extended condition with the operation of the driver piston 120. To operate the driver piston 120 and to move the rotating driver 110 from the retracted condition to the extended condition, the pressure relief valve 130 can be used in one implementation.

For instance, the pressure relief valve 130 can normally be open and can be kept open for a certain threshold of flow/pressure. The opened pressure relief valve 130 can allow fluid pressure to communicate with the driver piston 120 to activate the driver 110 to the extended condition.

As shown in FIG. 5, for example, the traction tool 100 is set to a drive condition during operation after run-in. Fluid is pumped at a defined flow rate from surface. A pressure drop is created at the orifice or restriction 107 in drive shaft bore 155. The motor 140 operates as before. Fluid flow communicates with the intake plate valve 146*a*, which controls the fluid flow to the chambers 142 formed between the stator 160 and the drive shaft 150 of the motor 140. Fluid flow from the chambers 142 passes through the exhaust plate valve 146*b*, which controls the exhaust of the fluid flow from the chambers 142. Eventually, the exhausted fluid flow then communicates back into the drive shaft's bore 155 through the cross port 151 (FIG. 5).

Hydraulic pressure in the drive shaft's bore 155 of the motor 140 passes through the side port 158 and enters the piston chamber 124 of the driver piston 120 to extend the arms 112*a-b*, carriers 114, and drive wheels 116. As the motor 140 operates, the driver 110 engaging in the sidewall of the wellbore (10) is rotated by the motor 140, which is activated by the fluid flow. In particular, the fluid flow is increased to activate the driver piston 120 against the bias of the spring 128. The driver piston 120 moves and activates the driver 110 from the retracted condition to the extended condition. When extended, the tracks 116 on the driver 110 engage inside the sidewall of the wellbore (10). The drive shaft 150 imparts rotation to the driver 110 so that driver 110 rotates about the longitudinal axis A. With the driver 110 extended and rotating, the tracks 116 spiral, wind, or thread along the inside surface of the wellbore tubing's sidewall, moving the traction tool 100 along the wellbore (10).

The traction tool 100 can then advance in the wellbore (10) by riding the transverse tracks 116 (e.g., wheels) on the rotating driver 110 along the wellbore (10). The rotating driver 110 thereby winds inside the wellbore (10), advancing the traction tool 100 forward to extend the reach of the coil tubing string (20).

Consequently, the traction tool 100 can move axially downhole as the driver 110 spirals, winds, or screws along the wellbore (10). As noted, portions of the tool's body 101 for the driver 110 rotate with the drive shaft 150. However, connected at the rotatable connection 170, separate portions of the tool's body 101 for the anchor 200 and ram 240 do not rotate.

After driving axially downhole, the traction tool 100 can be set to an anchored condition. As shown in FIGS. 6A-6B, the anchor 200 of the traction tool 100 is actuated to an extended condition to engage inside the wellbore (10). Anchoring can be performed once the traction tool 100 has reached a suitable extent in the wellbore to perform a desired operation, such as milling using a milling tool connected from the distal end of the traction tool 100. To activate the anchoring, the flow rate from surface is increased to a second level greater than initial defined rate.

The driver 110 can be disengaged in a number of ways. In particular, the pressure relief valve 130 can be responsive to a high-pressure level and can open to remove, relieve, or otherwise reduce the force on the driver piston 120 of the driver 110, allowing the driver 110 to disengage from the sidewall of the wellbore (10). In this case, the tracks 116 on the rotating driver 110 can then be selectively disengaged from the sidewall by moving the rotating driver 110 from the extended condition toward the retracted condition on the traction tool 100 with the operation of the driver piston 120. To deactivate the driver piston 120 and move the rotating driver 110 toward the retracted condition, the pressure relief valve 130 for the driver piston 120 can stop, relieve, or otherwise reduce the force on the driver piston 120 in response to increase pressure above a predetermined threshold. The spring 128 can return the driver piston 120 toward its initial retracted condition to at least disengage the driver 110 from the sidewall.

Hydraulic pressure in the mandrel bore 205 entering the port 206 of the anchor 200 can overcome the anchor's bias (e.g., force of spring 226) and can extend the slip elements 214 to engage the wellbore sidewall.

After anchoring, the traction tool 100 can be set to a ram condition. As shown in FIGS. 7A-7B, the ram 240 of the traction tool 100 is actuated to an extended condition. There continues to be exhaust of fluid, and the motor 140 can continue to rotate. However, the driver 110, which continues to be rotated, is retracted or disengaged because the driver piston 120 is no longer activated due to the operation of the pressure relief valve 130.

Ramming can be performed so the traction tool 100 can facilitate the downhole operation, such as milling using a milling tool connected from the distal end of the traction tool 100. To activate the ramming, the flow rate from surface is increased to a third level greater than second rate. Hydraulic pressure in the mandrel bore 205 entering the chambers 244*a-c* via ports 242*a-b* can push against the ram pistons 241*a-c* to overcome the ram's bias (e.g., force of springs 246). The hydraulic ram pistons 241*a-b* and arms 243*a-c* are released at the body lock ring 249, and the ram 240 can produce high axial force to be applied during the downhole operation (e.g., milling operation).

When the traction tool 100 is used with a drilling/milling motor, for example, the ram 240 extends downhole as drill depth increases. Milling can be performed while the ram pistons 241*a-c* and arms 243*a-c* extend and produce weight on the milling bit. When the limit of the ram pistons 241*a-c* and arms 243*a-c* is reached (e.g., about 12 inches or so), resistance is reduced. Shutting down the fluid flow from surface through the traction tool 100 would allow the return springs 246 to reset the traction tool 100 back to the run-in position. Repeating the staged flow cycles would move the traction tool 100 further downhole to allow further drilling/milling to be performed.

In the traction tool 100, various seals and bearing arrangements are disposed between various elements of the traction tool 100 to allow the elements to rotate or turn relative to one another. For example, a bearing 174 at the rotatable connection 170 is used between an end of the drive shaft 150 and an end 203 of the mandrel 202. The bearing 174 can be a radial bearing and can use any suitable structures, roller bearings, bushings, etc.

E. Alternative Driver

FIGS. 12A-12B and 13A-13B illustrate another driver 110' for a traction tool according to the present disclosure. In contrast to the previous arrangement, the present driver 110' does not include linkage arms and carriers. Instead, the driver 110' comprises segments 180 disposed about the longitudinal axis A. Each segment 180 is engaged between opposing ramps 182*a-b* of the traction tool (100) disposed on the drive shaft 150. The segments 180 can be interleaved with one another and can be dovetailed with the ramps 182*a-b*. The uphole ramp 182*a* as shown is connected to the piston housing 122 of driver piston (120). The downhole ramp 182*b* is part of or connected to the rotatable collar 172 of the rotatable connection (170).

During operation of a traction tool 100 having the driver 110' of FIG. 12A through FIG. 13B, the driver piston (120) is activated/deactivated and moves the uphole ramp 182*a* in a longitudinal direction relative to the downhole ramp 182*b*. The segments 180 wedged between the ramps 182*a-b* can be extended and retracted between the ramps 182*a-b* in response to the movement. As shown, the segments 182 can be interleaved with one another having opposing inclines, which can allow for greater extension and retraction. Additionally, the interleaving of the segments 180 can allow the segments 180 to have more surface area for the tracks 186 used to engage the sidewall of the wellbore tubing.

Figure 14:
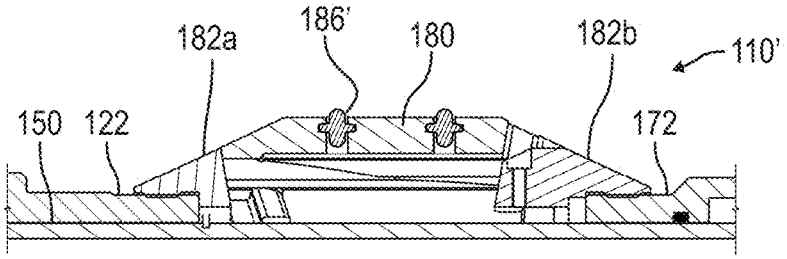
FIG. 14 illustrates an alternative driver for a traction tool of the present disclosure in an engaged condition.

As before, portion of the driver 110' is arranged at an angle transverse to the longitudinal axis A. In this example, the segments 180 include one or more tracks 186, teeth, rails, blades, or the like disposed on the segments 180. Other forms of tracks can be used, such as wheels, rollers, and the like. The tracks 186 are shown here as spiraling teeth or blades. Alternatively, the tracks can include one or more angled wheels 186' as shown in the detail of FIG. 14. These angled wheels 186' can be similar to those discussed previously.

F. Alternative Arrangements of Traction Tools

Figure 15A:
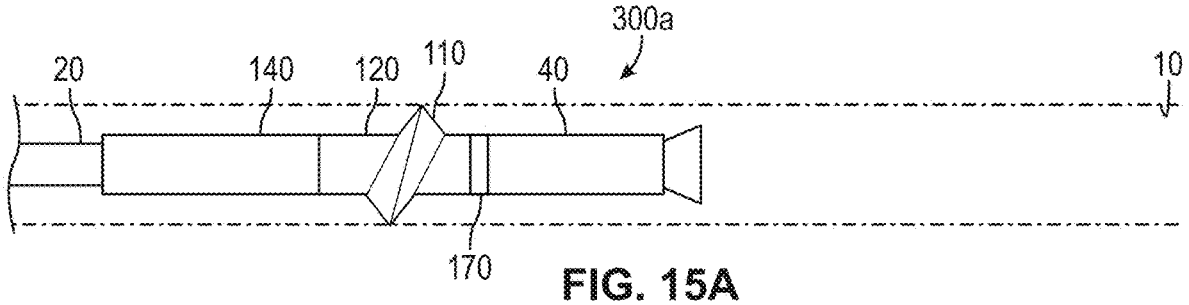
FIGS. 15A-15C illustrate modular arrangements of the disclosed traction tool.
Figure 15B:
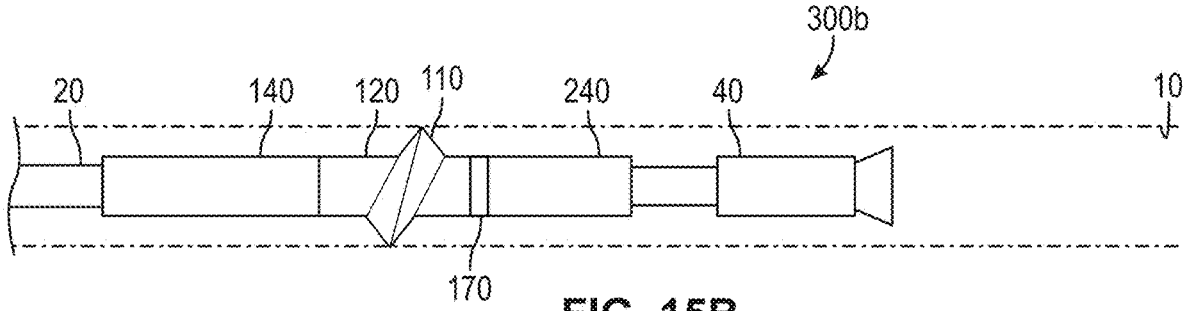
Figure 15C:
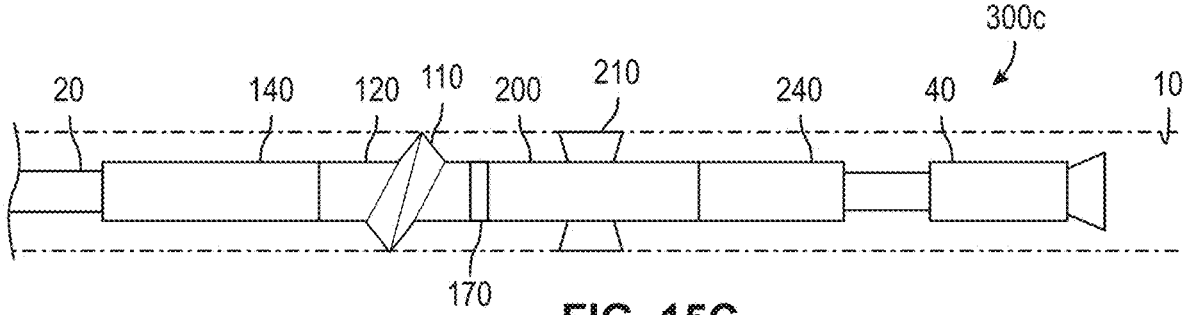

As shown in FIGS. 15A-15C, traction tools 300*a-c* of the present disclosure can be modular in construction. FIG. 15A shows the traction tool 300*a* in a modular arrangement having a driver 110, a driver piston 120, and a rotary drive or motor 140. A milling tool 40 is connected to the traction tool 300*a* for providing milling operations. This traction tool 300*a* can be used for milling out composite fracture plugs, ball seats, or the like in the tubing.

FIG. 15B shows the traction tool 300*b* in another modular arrangement in which a ram 240 is installed on the previous arrangement of the driver 110, the driver piston 120, and the rotary drive or motor 140. The milling tool 40 is installed on the ram 240. A rotatable connection 170 as disclosed herein can be used between the driver 110 and the ram 240. This traction tool 300*b* can be used for milling out tubing nipples or other components requiring more weight on bit.

FIG. 15C shows the traction tool 300*c* in yet another modular arrangement in which an anchor 200 and a ram 240 are installed on the previous arrangement of the driver 110, the driver piston 120, and the rotary drive or motor 140. The milling tool 40 is installed on the ram 240. A rotatable connection 170 as disclosed herein can be used between the driver 110 and the anchor 200. This traction tool 300*c* can also be used for milling out tubing nipples or other components requiring more weight on bit.

Figure 16A:
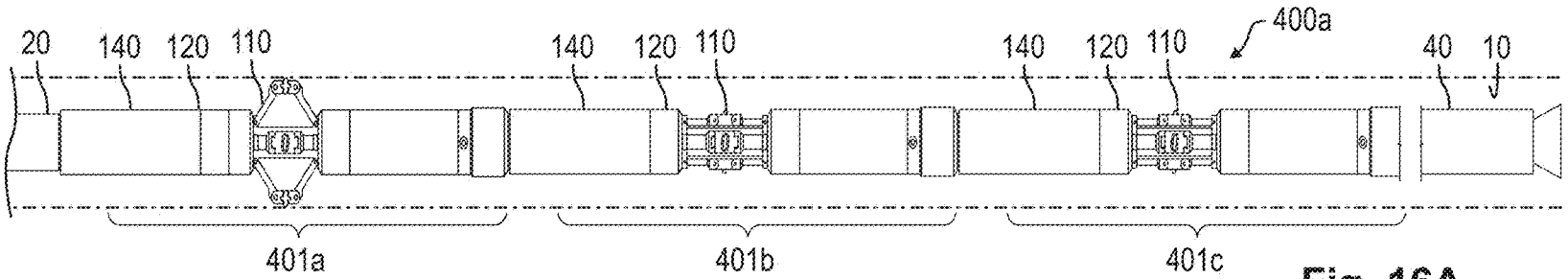
FIGS. 16A-16C illustrate additional modular arrangements of the disclosed traction tool.

Finally, various components of traction tools disclosed herein can be combined in additional modular arrangements. For example, FIG. 16A illustrates a traction tool 400*a* having two or more driver-motor combinations 401*a-c* connected in line between coiled tubing string 20 and a milling tool 40. Each driver-motor combination 401*a-b* includes a driver 110, a driver piston 120, and a motor 140. These elements 110, 120, 140 can be similar to those discussed previously and can each be similar to one another.

Here, three driver-motor combinations 401*a-b* are mounted in series. Exhaust ports (e.g., ports 148 in exhaust plate valve 146*b*) of the first driver-motor combination 401*a* are timed and are in line with intake ports (e.g., ports 148 in intake plate valve 146*a*) for the second driver-motor combination 401*b*. Likewise, intake ports (e.g., ports 148 in intake plate valve 146*a*) for the third driver-motor combination 401*c* are timed and are in line with exhaust ports (e.g., ports 148 in exhaust plate valve 146*b*) of second driver-motor combination 401*b*. The final exhaust ports (e.g., ports 148 in exhaust plate valve 146*b* and ports 144*b*) are positioned below the third driver-motor combination 401*c*. The in-line arrangement of the driver-motor combinations 401*a-b* can multiply the torque and axial force created by the drive systems. This traction tool 400*a* can further include a ram (240) or can include both an anchor (200) and a ram (240).

Figure 16B:
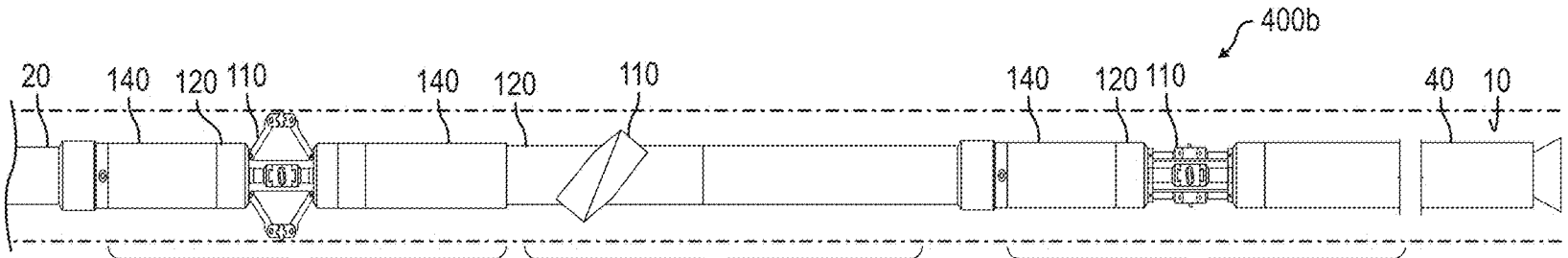

FIG. 16B illustrates another traction tool 400*b* having two or more driver-motor combinations 402*a-c* connected in line. Each driver-motor combination 402*a-c* includes a driver 110, a driver piston 120, and a motor 140, which can be similar to those discussed previously. As shown, the driver-motor combinations 402*a-c* can include different types of the driver, the piston, and the motor from one another. This traction tool 400*b* can further include a ram (240) or can include both an anchor (200) and a ram (240).

Figure 16C:
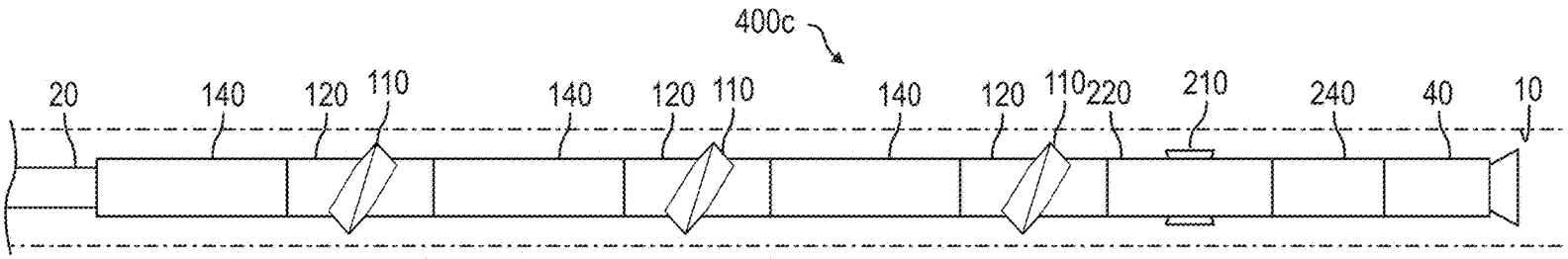

Finally, FIG. 16C illustrates yet another traction tool 400*c* having two or more driver-motor combinations 403*a-c* connected in line. Each driver-motor combination 403*a-c* includes a driver 110, a driver piston 120, and a motor 140, which can be similar to those discussed previously. This traction tool 400*c* further includes an anchor 200 having anchor elements 210 and includes a ram 240 as disclosed before. As these arrangements will show, traction tools according to the present disclosure can include various combinations of the components disclosed herein.

Configurations of the present disclosure can be characterized by the following clauses:

Clause 1. A traction tool (100) operable with fluid flow from coiled tubing (20) for use in a wellbore (10), the traction tool (100) comprising:

a motor (140) having a stator (160) and a drive shaft (150), the drive shaft (150) rotatably disposed in the stator (160), the drive shaft (150) extending along a longitudinal axis and having a shaft bore (155) therethrough for passage of the fluid flow, the motor (140) being configured to impart a rotation to the drive shaft (150) about the longitudinal axis in response to pressure of the fluid flow in a space (165) between the stator (160) and drive shaft (150);

a driver piston (120) disposed on the drive shaft (150) adjacent to the motor (140) and being rotatable with the rotation of the drive shaft (150), the driver piston (120) being movable with a first movement in a longitudinal direction in response to pressure of the fluid flow communicated from the motor (140);

a driver (110) disposed on the drive shaft (150) adjacent to the driver piston (120) and being rotatable with the rotation of the drive shaft (150), the driver (110) being movable in response to the first movement of the driver piston (120), the driver (110) being movable between a retracted condition and an extended condition relative to the longitudinal axis, the driver (110) in the extended condition being configured to engage inside the wellbore (10), a portion of the driver (110) being arranged at an angle transverse to the longitudinal axis; and at least one operational tool (200, 240, 40) disposed adjacent to the driver (110) and being operable in response to the fluid flow.

Clause 2. The traction tool (100) of Clause 1, wherein the at least one operational tool comprises a ram (240) disposed adjacent to the driver (110) and being connected by a rotatable connection (170) to the drive shaft (150), the ram (240) having a ram arm (241) and a ram piston chamber (244), the ram arm (241) being extendable along the longitudinal axis in response to hydraulic pressure in the ram piston chamber (244).

Clause 3. The traction tool (100) of Clause 1, wherein the at least one operational tool comprises an anchor (200) disposed adjacent to the driver (110) and being connected by a rotatable connection (170) to the drive shaft (150), the anchor (200) having one or more anchor elements (210), an anchor piston (224), and an anchor piston chamber (222), the anchor piston (224) being movable with a second movement toward the one or more anchor elements (210) in response to hydraulic pressure communicated from the shaft bore (155) of the drive shaft (150) to the anchor piston chamber (222), the one or more anchor elements (210) being movable to an extended condition in response to the second movement of the anchor piston (224), the one or more anchor elements (210) in the extended condition being configured to engage with the wellbore (10).

Clause 4. The traction tool (100) of Clause 1, wherein the at least one operational tool comprises an anchor (200) and a ram (240), wherein the anchor (200) is disposed adjacent to the driver (110) and is connected by a rotatable connection (170) to the drive shaft (150), the anchor (200) having one or more anchor elements (210), an anchor piston (224), and an anchor piston chamber (222), the anchor piston (224) being movable with a second movement toward the one or more anchor elements (210) in response to hydraulic pressure communicated from the shaft bore (155) of the drive shaft (150) to the anchor piston chamber (222), the one or more anchor elements (210) being movable to an extended condition in response to the second movement of the anchor piston (224), the one or more anchor elements (210) in the extended condition being configured to engage with the wellbore (10); and wherein the ram (240) is disposed adjacent to the anchor (200), the ram (240) having a ram arm (241) and a ram piston chamber (244), the ram arm (241) being extendable along the longitudinal axis in response to hydraulic pressure in the ram piston chamber (244).

Clause 5. The traction tool (100) of Clause 4, wherein the driver (110) is movable in response to a first level of hydraulic pressure overcoming a first bias of the driver (110); wherein the anchor piston (224) is movable in response to a second level of hydraulic pressure overcoming a second bias of the anchor (200), the second level being greater than the first level; and wherein the ram arm (241) is extendable in response to a third level of hydraulic pressure in the ram piston chamber (244) overcoming a third bias of the ram (240), the third level being greater than the first level.

Clause 6. The traction tool (100) of Clauses 3 or 4, wherein the driver (110) is movable in response to a first level of hydraulic pressure overcoming a first bias of the driver (110); wherein the anchor piston (224) is movable in response to a second level of hydraulic pressure overcoming a second bias of the anchor (200), the second level being greater than the first level.

Clause 7. The traction tool (100) of any one of Clauses 3 to 6, wherein the anchor (200) comprises a mandrel (202) defining a mandrel (202) bore in fluid communication with the shaft bore (155) of the drive shaft (150); and wherein the rotatable connection comprises a bearing disposed between the drive shaft (150) and the mandrel (202).

Clause 8. The traction tool (100) of Clause 7, wherein the anchor elements (210) comprise slips (214); and wherein the anchor (200) comprises:

a holder (216) movably disposed on the mandrel (202), the slips (214) hingedly connected to the holder (216); and first and second cones (220*a-b*) disposed on the mandrel (202) adjacent each end of the slips (214);

wherein the anchor piston (224) is disposed in fluid communication with a port (206) in the mandrel (202), the anchor piston (224) being movable in the longitudinal direction from a first position to a second position in response to hydraulic pressure communicated from the port (206) against the anchor piston (224), wherein the first cone (220*a*) is moveable with the movement of the anchor piston (224) toward the second cone (220*b*); and wherein the ends of the slips (214) engaged between the first and second cones (220*a-b*) are movable from a retracted condition to an extended condition in response to the engagement.

Clause 9. The traction tool (100) of any one of Clauses 1 to 8, wherein the at least one operational tool comprises a milling tool (40) disposed at a distal end of the traction tool (100).

Clause 10. The traction tool (100) of any one of Clauses 1 to 9, wherein the driver (110) comprises a plurality of carriers (114) disposed about the longitudinal axis, each carrier (114) hingedly connected to opposing linkage arms (112*a-b*), the linkage arms (112*a-b*) hingedly connected between sections of the traction tool (100) disposed on the drive shaft (150); wherein the portion of the driver (110) arranged at the angle transverse to the longitudinal axis comprises wheels (116) rotatably disposed on the carriers (114); and wherein the linkage arms (112*a-b*) are configured to extend and retract the carriers (114) in response to the movement of the driver piston (120) in the longitudinal direction.

Clause 11. The traction tool (100) of any one of Clauses 1 to 9, wherein the driver (110) comprises a plurality of segments (180) disposed about the longitudinal axis, each segment (180) engaged between opposing ramps (182*a-b*) of the traction tool (100) disposed on the drive shaft (150); wherein the portion of the driver (110) being arranged at the angle transverse to the longitudinal axis comprises: one or more teeth or tracks disposed on the segments; or one or more wheels rotatably disposed on the segments; and wherein the driver piston (120) is configured to move one of the ramps (182*a-b*) in the longitudinal direction toward another of the ramps (182*a-b*), the ramps (182*a-b*) being configured to extend and retract the segments (180) in response to the movement.

Clause 12. The traction tool (100) of any one of claims 1 to 11, wherein the driver piston (120) comprises a piston chamber (124) disposed in fluid communication with a bore (155) of the drive shaft (150); wherein the driver piston (120) is movable in the longitudinal direction in response to pressure in the piston chamber (124) to move the driver (110) laterally between the retracted and extended conditions relative to the longitudinal axis; and wherein the traction tool (100) comprises a pressure relief valve (130) disposed in fluid communication between the piston chamber (124) and a relief chamber (149*a*) of the driver piston (120), the pressure relief valve (130) being configured to communicate the pressure in the piston chamber (124) to the relief chamber (149*a*) in response to a predetermine pressure level.

Clause 13. The traction tool (100) of any one of claims 1 to 11, wherein the driver piston (120) comprises a piston chamber (124) disposed in fluid communication with the space (165) between the drive shaft (150) and stator (160); wherein the driver piston (120) is movable in the longitudinal direction in response to pressure in the piston chamber (124) to move the driver (110) laterally between the retracted and extended conditions relative to the longitudinal axis; and wherein the traction tool (100) further comprises a control valve (130') disposed in fluid communication between the space (165) of the motor (140) and the piston chamber (124) of the driver piston (120), the control valve (130') being configured to control communication of the pressure of the fluid flow from the space (165) to the piston chamber (124).

Clause 14. A bottom hole assembly operable with fluid flow from coiled tubing (20) for use in a wellbore (10), the bottom hole assembly having an operational tool and having at least one traction tool (100) of any one of Clauses 1 to 13 connected between the coil tubing and the operational tool.

Clause 15. A method for use in a wellbore (10), the method comprising:

deploying a traction tool (100) on coiled tubing (20) in the wellbore (10);

operating a motor (140) on the traction tool (100) using fluid flow from the coiled tubing (20);

transferring rotation of the motor (140) to a rotating driver (110) disposed on the traction tool (100);

selectively engaging transverse portions on the rotating driver (110) against the wellbore (10) by operating at least one piston on the traction tool (100) using the fluid flow from the coiled tubing (20) and moving the rotating driver (110) from a retracted condition to an extended condition on the traction tool (100) in response to the operation of the at least one piston;

advancing the traction tool (100) in the wellbore (10) by riding the transverse portions on the rotating drive along the wellbore (10); and engaging an anchor (200) on the traction tool (100) inside the wellbore (10) in response to a second level of hydraulic pressure greater than a first level used for activating the rotating driver (110).

Clause 16. The method of Clause 15, further comprising extending a ram (240) on the traction tool (100) longitudinally in the wellbore (10) in response to a third level of hydraulic pressure greater than the second level.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

The invention claimed is:

1. A traction tool operable with fluid flow from coiled tubing for use in a wellbore, the traction tool comprising:

a motor having a stator and a drive shaft, the drive shaft rotatably disposed in the stator, the drive shaft extending along a longitudinal axis and having a shaft bore therethrough for passage of the fluid flow, the motor being configured to impart a rotation to the drive shaft about the longitudinal axis in response to hydraulic pressure of the fluid flow in a space between the stator and drive shaft;

a driver piston disposed on the drive shaft adjacent to the motor and being rotatable with the rotation of the drive shaft, the driver piston being movable with a first movement in a longitudinal direction in response to hydraulic pressure of the fluid flow communicated from the motor;

a driver disposed on the drive shaft adjacent to the driver piston and being rotatable with the rotation of the drive shaft, the driver being movable in response to the first movement of the driver piston, the driver being movable between a retracted condition and an extended condition relative to the longitudinal axis, the driver in the extended condition being configured to engage inside the wellbore, a portion of the driver being arranged at an angle transverse to the longitudinal axis; and an anchor disposed adjacent to the driver and being connected by a rotatable connection to the drive shaft, the anchor having one or more anchor elements, an anchor piston, and an anchor piston chamber, the anchor piston being movable with a second movement toward the one or more anchor elements in response to hydraulic pressure of the fluid flow communicated from the shaft bore of the drive shaft to the anchor piston chamber, the one or more anchor elements being movable to an extended condition in response to the second movement of the anchor piston, the one or more anchor elements in the extended condition being configured to engage with the wellbore.

2. The traction tool of claim 1, wherein the driver comprises a plurality of carriers disposed about the longitudinal axis, each carrier hingedly connected to opposing linkage arms, the linkage arms hingedly connected between sections of the traction tool disposed on the drive shaft.

3. The traction tool of claim 1, wherein the driver comprises a plurality of segments disposed about the longitudinal axis, each segment engaged between opposing ramps of the traction tool disposed on the drive shaft.

4. The traction tool of claim 3, wherein the portion of the driver being arranged at the angle transverse to the longitudinal axis comprises: one or more teeth or tracks disposed on the segments; or one or more wheels rotatably disposed on the segments.

5. The traction tool of claim 3, wherein the driver piston is configured to move one of the ramps in the longitudinal direction toward another of the ramps, the ramps being configured to extend and retract the segments in response thereto.

6. The traction tool of claim 1, wherein the driver is movable in response to a first level of hydraulic pressure overcoming a first bias of the driver; and wherein the anchor piston is movable in response to a second level of hydraulic pressure overcoming a second bias of the anchor, the second level being greater than the first level.

7. The traction tool of claim 1, further comprising a ram disposed adjacent to the anchor, the ram having a ram arm and a ram piston chamber, the ram arm being extendable along the longitudinal axis in response to hydraulic pressure in the ram piston chamber.

8. The traction tool of claim 7, wherein the driver is movable in response to a first level of hydraulic pressure overcoming a first bias of the driver; wherein the anchor piston is movable in response to a second level of hydraulic pressure overcoming a second bias of the anchor, the second level being greater than the first level; and wherein the ram arm is extendable in response to a third level of hydraulic pressure in the ram piston chamber overcoming a third bias of the ram, the third level being greater than the first level.

9. The traction tool of claim 1, wherein the driver piston comprises a piston chamber disposed in fluid communication with a bore of the drive shaft; and wherein the driver piston is movable in the longitudinal direction in response to hydraulic pressure communicated into the piston chamber, the driver piston moved in the longitudinal direction being configured to move the driver laterally toward the extended condition relative to the longitudinal axis.

10. The traction tool of claim 9, comprising a pressure relief valve disposed in fluid communication between the piston chamber and a relief chamber of the driver piston, the pressure relief valve being configured to communicate the hydraulic pressure in the piston chamber to the relief chamber in response to a predetermine pressure level.

11. The traction tool of claim 10, wherein the drive shaft defines a side port communicating the bore of the drive shaft with the piston chamber; and wherein the driver piston comprises an outlet port communicating the relief chamber outside the traction tool.

12. The traction tool of claim 1, wherein the driver piston comprises a piston chamber disposed in fluid communication with the space between the drive shaft and the stator;

and wherein the driver piston is movable in the longitudinal direction in response to hydraulic pressure communicated into the piston chamber, the driver piston moved in the longitudinal direction being configured to move the driver laterally toward the extended condition relative to the longitudinal axis.

13. The traction tool of claim 12, comprising a control valve disposed in fluid communication between the space of the motor and the piston chamber of the driver piston, the control valve being configured to control communication of hydraulic pressure of the fluid flow from the space to the piston chamber.

14. The traction tool of claim 1, wherein the anchor comprises a mandrel defining a mandrel bore in fluid communication with the shaft bore of the drive shaft; and wherein the rotatable connection comprises a bearing disposed between the drive shaft and the mandrel.

15. The traction tool of claim 14, wherein the anchor elements comprise slips; and wherein the anchor comprises:

a holder movably disposed on the mandrel, the slips hingedly connected to the holder; and first and second cones disposed on the mandrel adjacent each end of the slips;

wherein the anchor piston is disposed in fluid communication with an anchor port in the mandrel, the anchor piston being movable in the longitudinal direction from a first position to a second position in response to hydraulic pressure communicated from the anchor port against the anchor piston, wherein the first cone is moveable with the movement of the anchor piston toward the second cone; and wherein the ends of the slips engaged between the first and second cones are movable from a retracted condition toward an extended condition in response to the engagement.

16. The traction tool of claim 14, further comprising a ram having at least one ram arm movably disposed on the mandrel, the at least one ram arm defining a ram piston chamber in fluid communication via a ram port with the mandrel bore, the at least one ram arm being extendable on the mandrel along the longitudinal axis in response to hydraulic pressure communicated from the ram port to the ram piston chamber.

17. A bottom hole assembly operable with fluid flow from coiled tubing for use in a wellbore, the bottom hole assembly having a milling tool and having at least one traction tool of claim 1 connected between the coil tubing and the milling tool.

18. A traction tool operable with fluid flow from coiled tubing for use in a wellbore, the traction tool comprising:

a motor having a stator and a drive shaft, the drive shaft rotatably disposed in the stator, the drive shaft extending along a longitudinal axis and having a shaft bore therethrough for passage of the fluid flow, the motor being configured to impart a rotation to the drive shaft about the longitudinal axis in response to pressure of the fluid flow in a space between the stator and drive shaft;

a driver piston disposed on the drive shaft adjacent to the motor and being rotatable with the rotation of the drive shaft, the driver piston being movable with a first movement in a longitudinal direction in response to hydraulic pressure of the fluid flow communicated from the motor;

a driver disposed on the drive shaft adjacent to the driver piston and being rotatable with the rotation of the drive shaft, the driver being movable in response to the first movement of the driver piston, the driver being movable between a retracted condition and an extended condition relative to the longitudinal axis, the driver in the extended condition being configured to engage inside the wellbore, a portion of the driver being arranged at an angle transverse to the longitudinal axis; and a ram disposed adjacent to the driver and being connected by a rotatable connection to the drive shaft, the ram having a ram arm and a ram piston chamber, the ram arm being extendable along the longitudinal axis in response to hydraulic pressure in the ram piston chamber.

19. A method for use in a wellbore, the method comprising:

deploying a traction tool on coiled tubing in the wellbore;

operating a motor on the traction tool using fluid flow from the coiled tubing;

transferring rotation of the motor to a rotating driver disposed on the traction tool;

selectively engaging transverse portions on the rotating driver against the wellbore by operating at least one piston on the traction tool using the fluid flow from the coiled tubing and moving the rotating driver from a retracted condition to an extended condition on the traction tool in response to the operation of the at least one piston;

advancing the traction tool in the wellbore by riding the transverse portions on the rotating drive along the wellbore; and engaging an anchor on the traction tool inside the wellbore in response to a second level of hydraulic pressure greater than a first level used for activating the rotating driver.

20. The method of claim 19, further comprising extending a ram on the traction tool longitudinally in the wellbore in response to a third level of hydraulic pressure greater than the second level.

* * * * *